US011248786B2

(12) United States Patent
Karkow et al.

(10) Patent No.: US 11,248,786 B2
(45) Date of Patent: Feb. 15, 2022

(54) METHOD FOR A PERFORATED FLAME HOLDER WITH ADJUSTABLE FUEL NOZZLE

(71) Applicant: CLEARSIGN TECHNOLOGIES CORPORATION, Seattle, WA (US)

(72) Inventors: Douglas W. Karkow, Mount Vernon, IA (US); Joseph Colannino, Oceanside, CA (US); James K. Dansie, Seattle, WA (US); Jesse Dumas, Seattle, WA (US); Donald Kendrick, Bellevue, WA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 97 days.

(21) Appl. No.: 16/728,548

(22) Filed: Dec. 27, 2019

(65) Prior Publication Data

US 2020/0132296 A1 Apr. 30, 2020

Related U.S. Application Data

(60) Division of application No. 15/663,458, filed on Jul. 28, 2017, now Pat. No. 10,578,301, which is a (Continued)

(51) Int. Cl.
*F23D 11/44* (2006.01)
*F23N 5/24* (2006.01)

(Continued)

(52) U.S. Cl.
CPC ..... *F23D 11/443* (2013.01); *F23D 9/00* (2013.01); *F23D 11/38* (2013.01); *F23D 14/14* (2013.01);

(Continued)

(58) Field of Classification Search
CPC ..... F23D 14/26; F23D 14/72; F23D 11/443; F23D 14/14; F23D 9/00; F23D 11/38; F23N 5/025; F23N 5/245
See application file for complete search history.

(56) References Cited

U.S. PATENT DOCUMENTS 2,095,065 A 10/1937 Hays
2,828,813 A 4/1958 Holden (Continued)

FOREIGN PATENT DOCUMENTS

WO WO 1995/000803 1/1995
WO WO 2007/022772 3/2007

(Continued)

OTHER PUBLICATIONS

Arnold Schwarzenegger, "A Low NOx Porous Ceramics Burner Performance Study," California Energy Commission Public Interest Energy Research Program, Dec. 2007, San Diego State University Foundation, p. 5.

(Continued)

*Primary Examiner* — Alfred Basichas
(74) *Attorney, Agent, or Firm* — Nicholas Sheppard Bromer; Christopher A. Wiklof; Launchpad IP, Inc.

(57) ABSTRACT

A method for a combustion system includes outputting fuel from an adjustable-position fuel nozzle onto a perforated flame holder, the fuel being directed for mixture with an oxidant en route to the perforated flame holder. A combustion reaction of the fuel and the oxidant is supported within the perforated flame holder. A position of the adjustable-position fuel nozzle may be changed relative to the flame holder. A first flow of fuel may be output when the adjustable position fuel nozzle is in an extended state, and a second flow of fuel may be output when the adjustable-position fuel nozzle is in a retracted state.

11 Claims, 16 Drawing Sheets

Related U.S. Application Data continuation-in-part of application No. PCT/US2016/018331, filed on Feb. 17, 2016.

(60) Provisional application No. 62/117,432, filed on Feb. 17, 2015.

(51) Int. Cl.

| | |
|---|---|
| ***F23N 5/02*** | (2006.01) |
| ***F23D 14/14*** | (2006.01) |
| ***F23D 14/72*** | (2006.01) |
| ***F23D 14/26*** | (2006.01) |
| ***F23D 9/00*** | (2006.01) |
| ***F23D 11/38*** | (2006.01) |

(52) U.S. Cl.

CPC ..... *F23D 14/26* (2013.01); *F23D 14/72* (2013.01); *F23N 5/025* (2013.01); *F23N 5/245* (2013.01)

(56) References Cited

U.S. PATENT DOCUMENTS

| | | | |
|---|---|---|---|
| 3,008,513 | A | 11/1961 | Holden |
| 3,324,924 | A | 6/1967 | Hailstone et al. |
| 4,021,188 | A | 5/1977 | Yamagishi et al. |
| 4,408,461 | A | 10/1983 | Bruhwiler et al. |
| 4,483,673 | A | 11/1984 | Murai et al. |
| 4,588,373 | A | 5/1986 | Tonon et al. |
| 4,643,667 | A | 2/1987 | Fleming |
| 4,673,349 | A | 6/1987 | Abe et al. |
| 4,726,767 | A | 2/1988 | Nakajima |
| 4,752,213 | A | 6/1988 | Grochowski et al. |
| 4,773,847 | A | 9/1988 | Shukla et al. |
| 4,850,862 | A | 7/1989 | Bjerklie |
| 4,919,609 | A | 4/1990 | Sarkisian et al. |
| 5,326,257 | A | 7/1994 | Taylor et al. |
| 5,375,999 | A | 12/1994 | Aizawa et al. |
| 5,380,192 | A | 1/1995 | Hamos |
| 5,409,375 | A | 4/1995 | Butcher |
| 5,431,557 | A | 7/1995 | Hamos |
| 5,439,372 | A | 8/1995 | Duret et al. |
| 5,441,402 | A | 8/1995 | Reuther et al. |
| 5,641,282 | A | 6/1997 | Lee et al. |
| 5,749,721 | A | 5/1998 | Klinge et al. |
| 5,993,192 | A | 11/1999 | Schmidt et al. |
| 6,095,798 | A | 8/2000 | Mitani et al. |
| 6,129,545 | A | 10/2000 | Kahlke et al. |
| 6,159,001 | A | 12/2000 | Kushch et al. |
| 6,162,049 | A | 12/2000 | Pellizzari et al. |
| 6,270,336 | B1 | 8/2001 | Terashima et al. |
| 6,997,701 | B2 | 2/2006 | Volkert et al. |
| 7,241,137 | B2 | 7/2007 | Leinemann et al. |
| 8,282,389 | B2 | 10/2012 | Dhulst et al. |
| 9,377,189 | B2 * | 6/2016 | Ruiz ..... F23C 15/00 |
| 9,377,190 | B2 | 6/2016 | Karkow et al. |
| 9,388,981 | B2 | 7/2016 | Karkow et al. |
| 9,447,965 | B2 | 9/2016 | Karkow et al. |
| 9,562,682 | B2 | 2/2017 | Karkow et al. |
| 2002/0155403 | A1 | 10/2002 | Griffin et al. |
| 2003/0054313 | A1 | 3/2003 | Rattner et al. |
| 2004/0058290 | A1 | 3/2004 | Mauzey et al. |
| 2005/0181321 | A1 | 8/2005 | Hart et al. |
| 2006/0008755 | A1 | 1/2006 | Leinemann et al. |
| 2006/0141413 | A1 | 6/2006 | Masten et al. |
| 2009/0053664 | A1 | 2/2009 | Staller et al. |
| 2010/0178219 | A1 | 7/2010 | Verykios et al. |
| 2011/0076628 | A1 | 3/2011 | Miura et al. |
| 2012/0164590 | A1 | 6/2012 | Mach |
| 2012/0231398 | A1 | 9/2012 | Carpentier et al. |
| 2014/0234786 | A1 * | 8/2014 | Ruiz ..... F23C 99/001 431/2 |
| 2015/0118629 | A1 | 4/2015 | Colannino et al. |
| 2015/0276217 | A1 | 10/2015 | Karkow et al. |
| 2015/0316261 | A1 | 11/2015 | Karkow et al. |
| 2015/0330625 | A1 | 11/2015 | Karkow et al. |
| 2015/0362177 | A1 | 12/2015 | Krichtafovitch et al. |
| 2015/0362178 | A1 | 12/2015 | Karkow et al. |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0046524 | A1 | 2/2016 | Colannino et al. |
| 2016/0230984 | A1 | 8/2016 | Colannino et al. |
| 2016/0238240 | A1 | 8/2016 | Colannino et al. |
| 2016/0238242 | A1 | 8/2016 | Karkow et al. |
| 2016/0238277 | A1 | 8/2016 | Colannino et al. |
| 2016/0238318 | A1 | 8/2016 | Colannino et al. |
| 2016/0245509 | A1 | 8/2016 | Karkow et al. |
| 2016/0276212 | A1 | 10/2016 | Rutkowski et al. |
| 2016/0290639 | A1 | 10/2016 | Karkow et al. |
| 2016/0298838 | A1 | 10/2016 | Karkow et al. |
| 2016/0298840 | A1 | 10/2016 | Karkow et al. |
| 2016/0305660 | A1 | 10/2016 | Colannino et al. |
| 2016/0348899 | A1 | 12/2016 | Karkow et al. |
| 2016/0348900 | A1 | 12/2016 | Colannino et al. |
| 2016/0348901 | A1 | 12/2016 | Karkow et al. |
| 2017/0010019 | A1 | 1/2017 | Karkow et al. |
| 2017/0038063 | A1 | 2/2017 | Colannino et al. |
| 2017/0038064 | A1 | 2/2017 | Colannino et al. |
| 2017/0051913 | A1 | 2/2017 | Colannino et al. |
| 2017/0146232 | A1 | 5/2017 | Karkow et al. |
| 2017/0184303 | A1 | 6/2017 | Colannino et al. |
| 2017/0191655 | A1 | 7/2017 | Colannino et al. |
| 2017/0268772 | A1 | 9/2017 | Lang et al. |

FOREIGN PATENT DOCUMENTS

| | | |
|---|---|---|
| WO | WO 2014/127305 | 8/2014 |
| WO | WO 2014/183135 | 11/2014 |
| WO | WO 2015/123149 | 8/2015 |
| WO | WO 2015/123683 | 8/2015 |
| WO | WO 2016/105489 | 6/2016 |
| WO | WO 2016/133934 | 8/2016 |
| WO | WO 2016/133936 | 8/2016 |
| WO | WO 2016/134068 | 8/2016 |
| WO | WO 2016/141362 | 9/2016 |
| WO | WO 2017/048638 | 3/2017 |
| WO | WO 2017/1240008 | 7/2017 |

OTHER PUBLICATIONS

Fric, Thomas F., "Effects of Fuel-Air Unmixedness on NOx Emissions," Sep.-Oct. 1993 Journal of Propulsion and Power, vol. 9, No. 5, pp. 708-713.

Howell, Jr., et al.; "Combustion of Hydrocarbon Fuels Within Porous Inert Media," Dept. of Mechanical Engineering, The University of Texas at Austin. Prog. Energy Combust. ScL, 1996, vol. 22, p. 121-145.

Takeno, Abstract, Combustion Institute 1982, 1 page.

PCT International Search Report and Written Opinion of PCT Application No. PCT/US2016/018331 dated Jul. 12, 2016.

* cited by examiner

METHOD FOR A PERFORATED FLAME HOLDER WITH ADJUSTABLE FUEL NOZZLE

CROSS-REFERENCE TO RELATED APPLICATIONS

The present application is a U.S. Divisional Application of U.S. patent application Ser. No. 15/663,458, entitled "PERFORATED FLAME HOLDER WITH ADJUSTABLE FUEL NOZZLE," filed Jul. 28, 2017, U.S. patent application Ser. No. 15/663,458 is a Continuation-in-Part Application of International Patent Application No. PCT/US2016/018331, entitled "PERFORATED FLAME HOLDER WITH ADJUSTABLE FUEL NOZZLE," filed Feb. 17, 2016. International Patent Application No. PCT/US2016/018331 claims priority benefit from U.S. Provisional Patent Application No. 62/117,432, entitled "PERFORATED FLAME HOLDER WITH ADJUSTABLE FUEL NOZZLE," filed Feb. 17, 2015. Each of the foregoing applications, to the extent not inconsistent with the disclosure herein, is incorporated herein by reference.

SUMMARY

According to an embodiment, a combustion system includes an oxidant source, an adjustable-position fuel nozzle, and a perforated flame holder in a combustion environment. The oxidant source outputs oxidant into the combustion environment for mixing with fuel. The adjustable-position fuel nozzle outputs the fuel onto the perforated flame holder. The perforated flame holder receives the fuel and oxidant mixture and supports a combustion reaction of the fuel and oxidant mixture within the perforated flame holder. The position of the adjustable-position fuel nozzle relative to the perforated flame holder can be adjusted in order to achieve selected characteristics of the combustion reaction.

According to an embodiment, the adjustable-position fuel nozzle can be extended to a position relatively close to the perforated flame holder during a preheating operation. In this position, the adjustable-position fuel nozzle can support a startup flame near the perforated flame holder in order to heat the perforated flame holder to a threshold temperature at which the perforated flame holder can support a stable combustion reaction of the fuel and the oxidant. When the temperature of the perforated flame holder has reached the threshold temperature, the adjustable-position fuel nozzle retracts from the perforated flame holder and outputs fuel toward the perforated flame holder. Because the perforated flame holder has been preheated to the threshold temperature, the perforated flame holder supports a combustion reaction of the fuel and the oxidant within the perforated flame holder.

According to an embodiment, a method includes outputting a first flow of fuel from an adjustable-position fuel nozzle and preheating a perforated flame holder to a threshold temperature by supporting a preheating flame of the first flow of fuel near the perforated flame holder. The method further includes retracting the adjustable-position fuel nozzle from the perforated flame holder after the perforated flame holder has been preheated to the threshold temperature, outputting a second flow of fuel from the adjustable-position fuel nozzle onto the perforated flame holder after retracting the adjustable-position fuel nozzle from the perforated flame holder, and supporting a combustion reaction of the second flow of fuel within the perforated flame holder.

DETAILED DESCRIPTION

Figure 1:
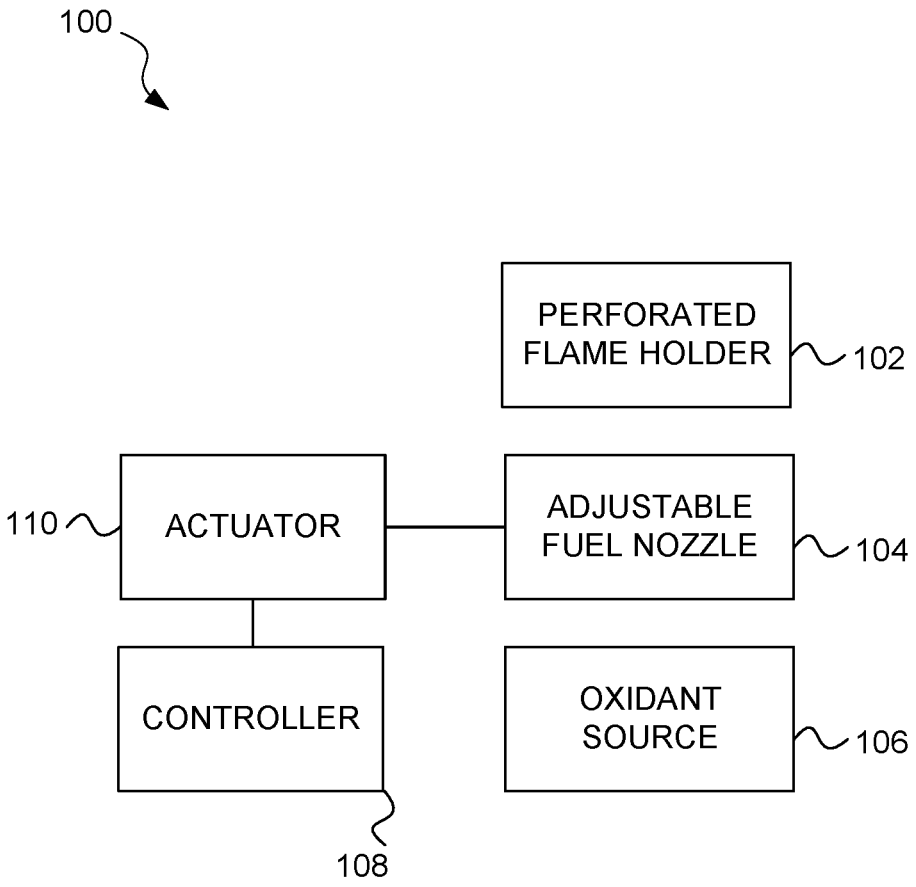
FIG. 1 is a diagram of a combustion system including a perforated flame holder and an adjustable-position fuel nozzle, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a block diagram of a combustion system 100, according to an embodiment. The combustion system 100 includes a perforated flame holder 102, an adjustable-position fuel nozzle 104, and an oxidant source 106 in a combustion environment. An actuator 110 is coupled to the adjustable-position fuel nozzle 104. A controller 108 is coupled to the actuator 110.

According to an embodiment, the oxidant source 106 outputs an oxidant into the combustion environment for mixing with fuel. The adjustable-position fuel nozzle 104 outputs a fuel toward the perforated flame holder 102. Under selected conditions, the perforated flame holder 102 sustains a combustion reaction of the fuel and oxidant mixture within the perforated flame holder 102. For example, if the perforated flame holder 102 is heated to a threshold temperature, and if the fuel and oxidant enter the perforated flame holder 102, then the perforated flame holder 102 will sustain a combustion reaction of the fuel and oxidant mixture within the perforated flame holder 102.

According to an embodiment, the position of the adjustable-position fuel nozzle 104 can be adjusted in order to promote combustion of the fuel and oxidant mixture within the perforated flame holder 102. According to an embodiment, the actuator 110 can adjust the position of the adjustable-position fuel nozzle 104 in order to achieve selected characteristics of a combustion reaction within the perforated flame holder 102. The controller 108 can control the actuator 110 to adjust the position of the perforated flame holder 102. Alternatively, a technician can operate the actuator 110 directly without the controller 108.

According to an embodiment, the adjustable-position fuel nozzle 104 can be utilized to preheat the perforated flame holder 102 to a threshold temperature at which the perforated flame holder 102 can sustain a combustion reaction of the fuel and the oxidant. In particular, when the adjustable-position fuel nozzle 104 is in an extended position near the perforated flame holder 102, the adjustable-position fuel nozzle 104 can support a startup flame near the perforated flame holder 102 in order to heat the perforated flame holder 102 to the threshold temperature. Once the perforated flame holder 102 has reached the threshold temperature, the controller 108 can cause the actuator 110 to retract the perforated flame holder 102 further from the perforated flame holder 102. In the retracted position, the adjustable-position fuel nozzle 104 outputs fuel onto the perforated flame holder 102, and the perforated flame holder 102 supports a combustion reaction of the fuel and the oxidant.

According to an embodiment, the adjustable-position fuel nozzle 104 can be configured to emit a fuel jet selected to entrain the oxidant to form a fuel and oxidant mixture as the fuel jet and the oxidant travel along a path to the perforated flame holder 102. Additionally, or alternatively (particularly when the oxidant source includes a blower used to deliver oxidant contained in combustion air), the oxidant source 106 can be configured to entrain the fuel as the fuel and the oxidant travel toward the perforated flame holder 102.

Figure 2:
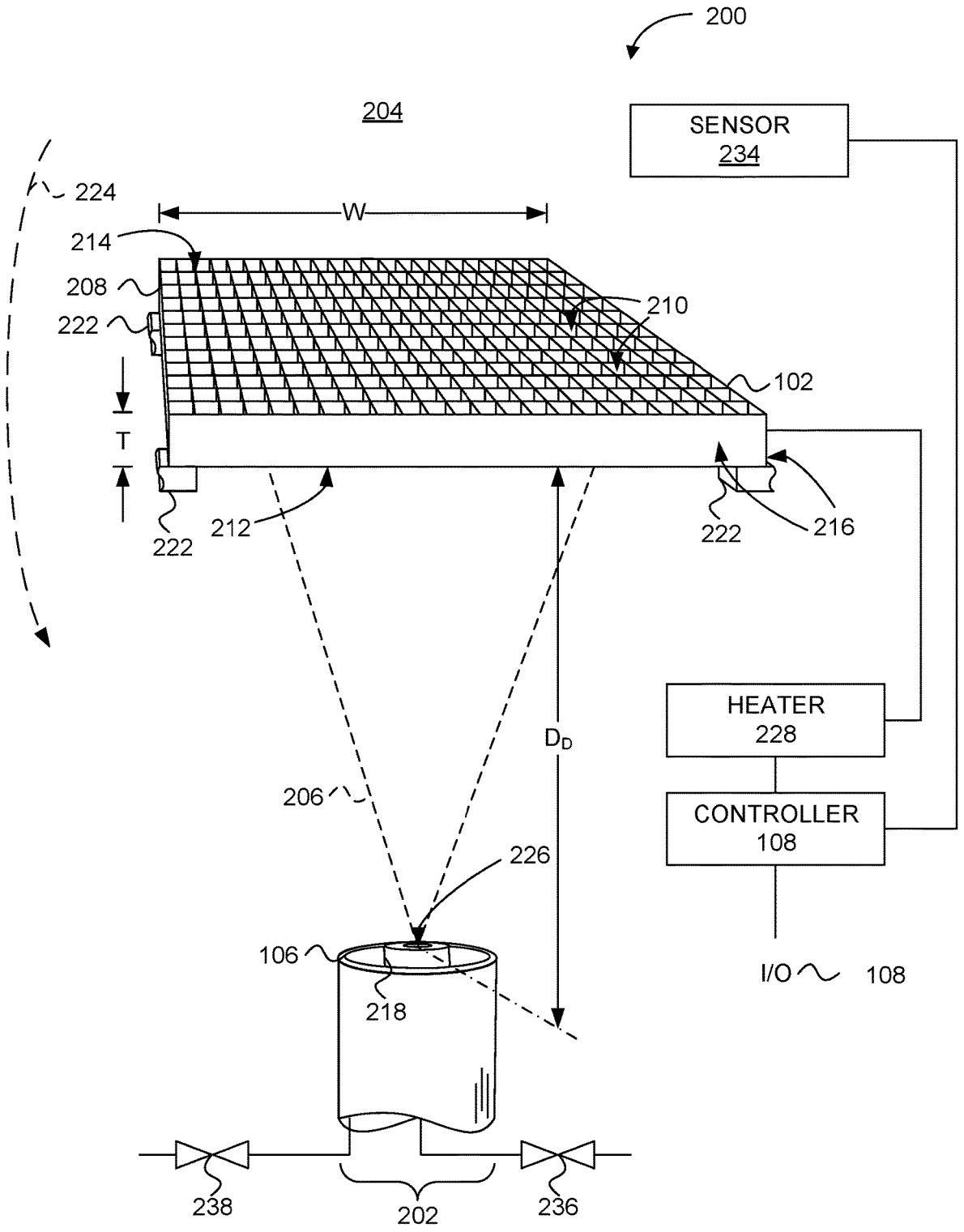
FIG. 2 is a simplified perspective view of a burner system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of burner systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
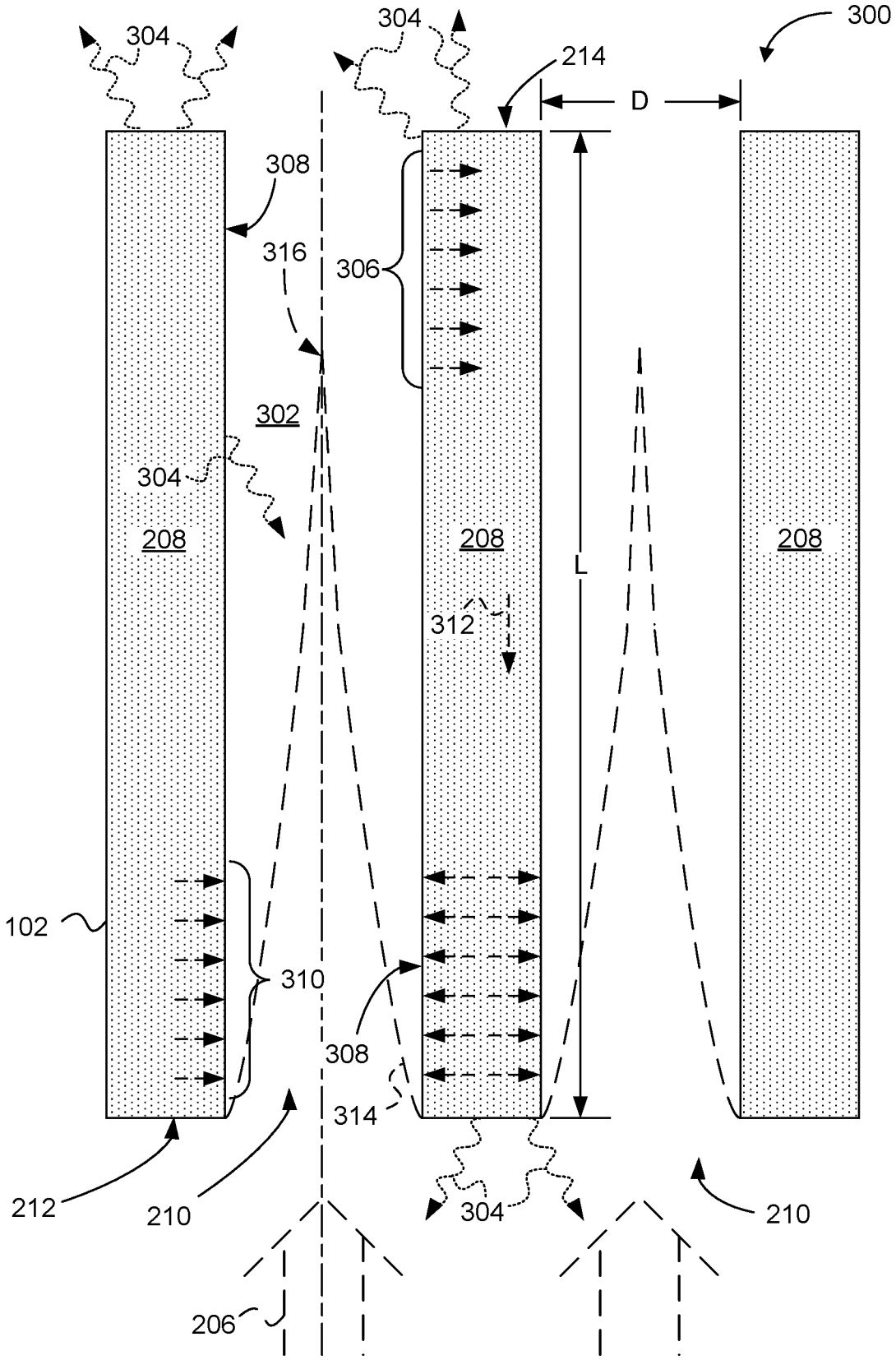
FIG. 3 is a side sectional diagram of a portion of the perforated flame holder of FIGS. 1 and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and the output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to the heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to the walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and the output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the corresponding perforation 210. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 106 configured to output a fluid including the oxidant. For example, the fuel nozzle 218 can be configured to output pure fuel. The oxidant source 106 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and the oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel, and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture becomes sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle 218 configured to output fuel into the premix chamber, and an oxidant (e.g., combustion air) channel configured to output the oxidant into the premix chamber. A flame arrestor can be disposed between the premix fuel and oxidant source 202 and the perforated flame holder 102, and can be configured to prevent flame flashback into the premix fuel and oxidant source 202.

The oxidant source 106, whether configured for entrainment in the combustion volume 204 or for premixing, can include a blower 238 configured to force the oxidant through the fuel and oxidant source 202.

The perforated flame holder support structure 222 can be configured to support the perforated flame holder 102 from a floor or wall (not shown) of the combustion volume 204, for example. In another embodiment, the perforated flame holder support structure 222 supports the perforated flame holder 102 from the fuel and oxidant source 202. Alternatively, the perforated flame holder support structure 222 can suspend the perforated flame holder 102 from an overhead structure (such as a flue, in the case of an up-fired system). The perforated flame holder support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas recirculation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example, the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including the perforated flame holder body 208 and the perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and the output faces 212, 214. In another embodiment, the perforations 210 can be parallel to one another and formed at an angle relative to the input and the output faces 212, 214. In another embodiment, the perforations 210 can be non-parallel to one another. In another embodiment, the perforations 210 can be non-parallel to one another and non-intersecting. In another embodiment, the perforations 210 can be intersecting. The perforated flame holder body 208 can be one piece or can be formed from a plurality of sections.

In another embodiment, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g., Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e., an equivalence ratio of ~0.87. Use of even leaner mixtures is possible, but may result in elevated levels of $O_2$. Moreover, the inventors believe the perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
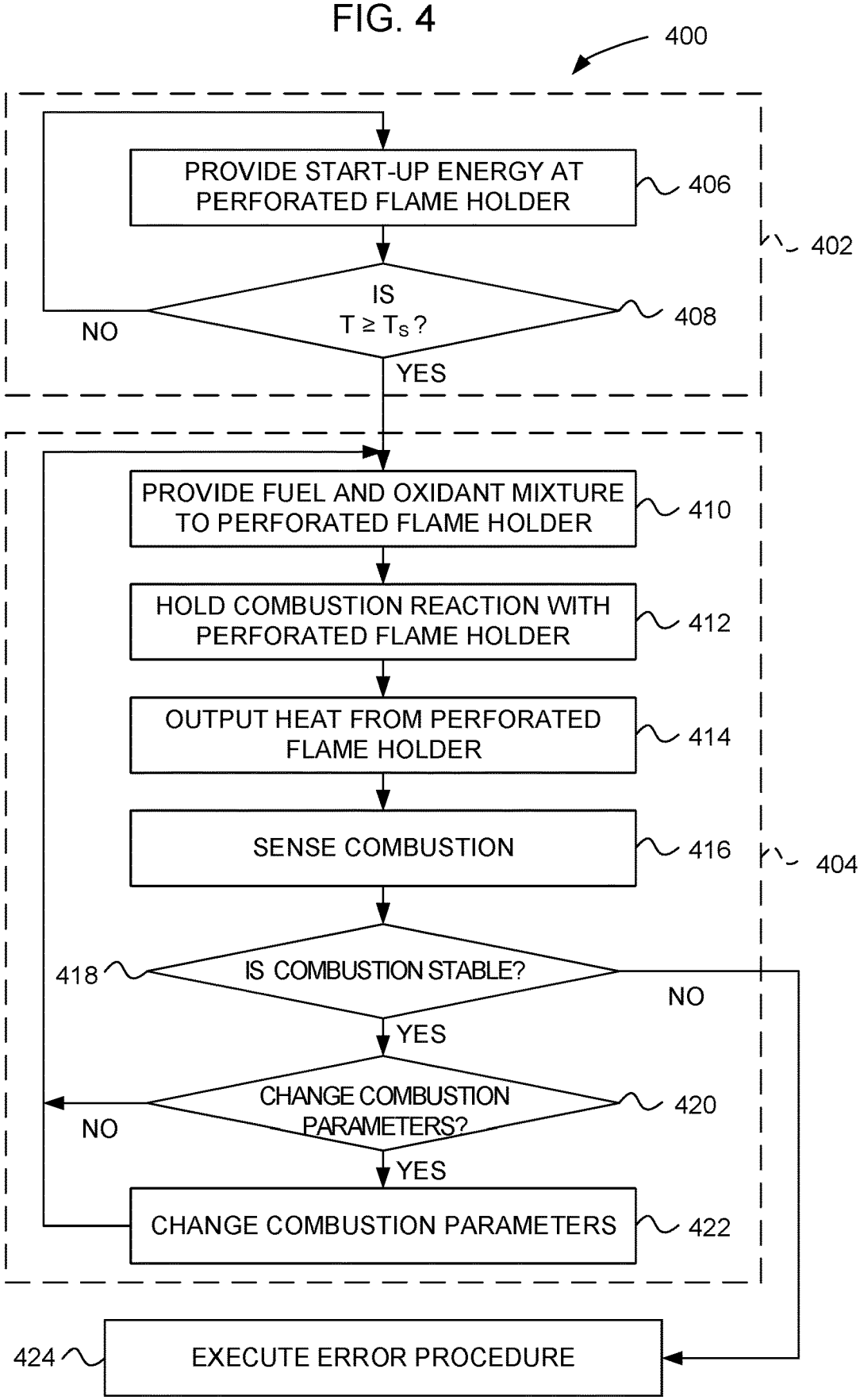
FIG. 4 is a flow chart showing a method for operating a burner system including the perforated flame holder of FIGS. 1, 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In decision step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from decision step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in decision step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 106 configured to output oxidant (e.g., combustion air) adjacent to the fuel stream 206. The fuel nozzle 218 and the oxidant source 106 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 108 operatively coupled to the heater 228 and to a data interface 232. For example, the controller 108 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 108 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater 228 can be configured to heat up the perforated flame holder 102 to an operating temperature. The heater 228 can further include a power supply and a switch operable, under control of the controller 108, to selectively couple the power supply to the electrical resistance heater 228.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208.

Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and the fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 108, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the controller 108. The sensor 234 can include a heat sensor configured to detect infrared radiation or a temperature of the perforated flame holder 102. The controller 108 can be configured to control the heating apparatus 228 responsive to input from the sensor 234. Optionally, a fuel control valve 236 can be operatively coupled to the controller 108 and configured to control a flow of fuel to the fuel and oxidant source 202. Additionally or alternatively, an oxidant blower or damper 238 can be operatively coupled to the controller 108 and configured to control flow of the oxidant (or combustion air).

The sensor 234 can further include a combustion sensor operatively coupled to the controller 108, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 108 can be configured to control the fuel control valve 236 responsive to input from the combustion sensor 234. The controller 108 can be configured to control the fuel control valve 236 and/or the oxidant blower or damper 238 to control a preheat flame type of heater 228 to heat the perforated flame holder 102 to an operating temperature. The controller 108 can similarly control the fuel control valve 236 and/or the oxidant blower or damper 238 to change the fuel and oxidant mixture 206 flow responsive to a heat demand change received as data via the data interface 232.

Figure 5A:
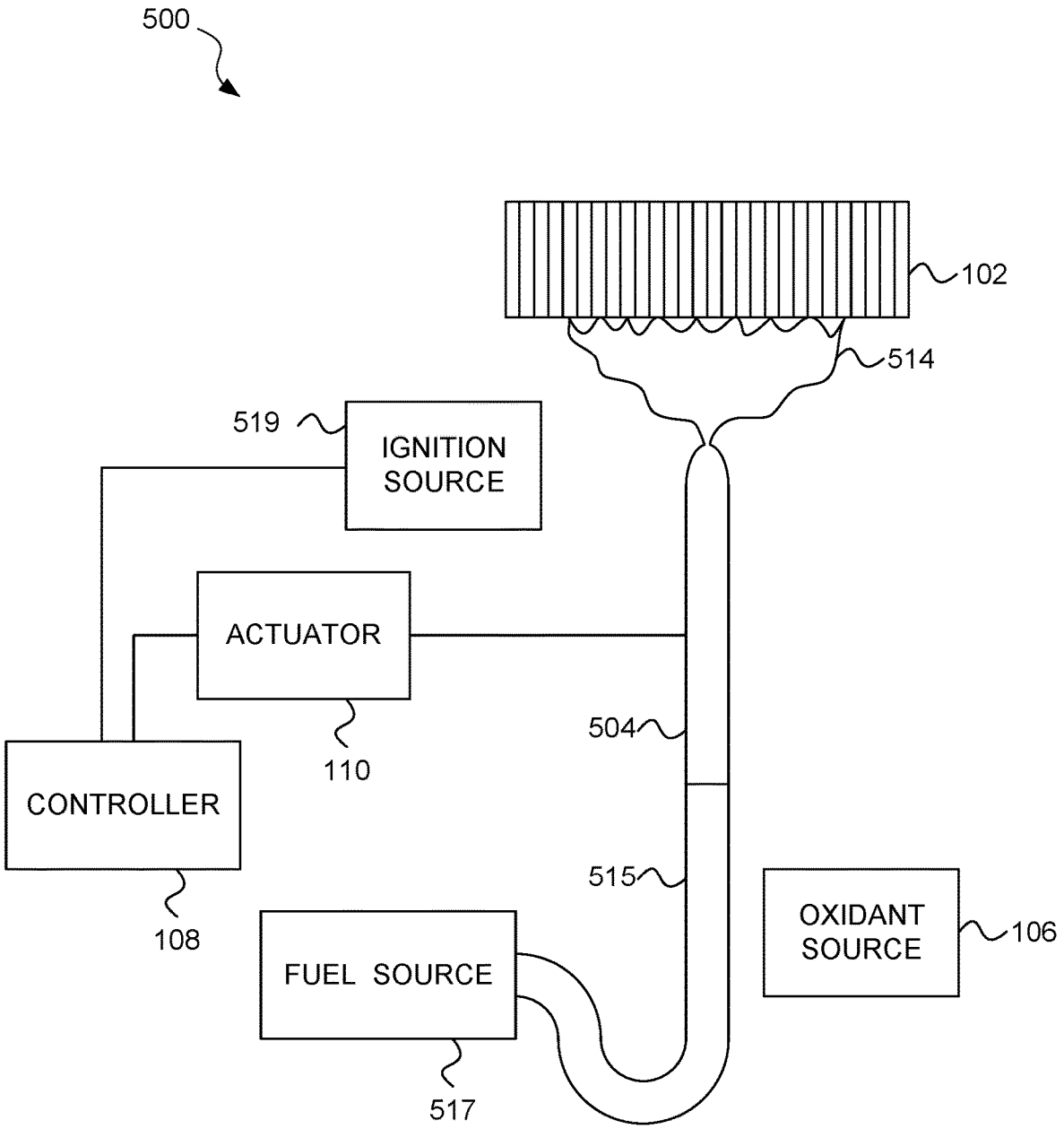
FIG. 5A is a diagram of a combustion system including a perforated flame holder and an adjustable-position fuel nozzle in an extended position, according to an embodiment.

FIG. 5A is a diagram of a combustion system 500, according to an embodiment. The combustion system 500 includes a perforated flame holder 102, an oxidant source 106, a fuel source 517, and an adjustable-position fuel nozzle 504 configured to receive fuel from the fuel source 517. A flexible hose 515 is coupled between the fuel source 517 and the adjustable-position fuel nozzle 504. An actuator 110 is coupled to the adjustable-position fuel nozzle 504 and is configured to adjust the position of the adjustable-position fuel nozzle 504. A controller 108 is coupled to the actuator 110.

In FIG. 5A, the adjustable-position fuel nozzle 504 is in an extended position wherein the adjustable-position fuel nozzle 504 acts as a preheating mechanism for the perforated flame holder 102. In particular, the actuator 110, under control of the controller 108, has extended the position of the adjustable-position fuel nozzle 504 near the perforated flame holder 102. The oxidant source 106 outputs oxidant. The fuel source 517 supplies fuel to the adjustable-position fuel nozzle 504. An ignition source 519 may be positioned near the adjustable-position fuel nozzle 504 to selectively ignite fuel exiting the adjustable-position fuel nozzle 504. The ignition source 519 is coupled to the controller 108. The adjustable-position fuel nozzle 504 outputs the fuel and cooperates with the ignition source 519 such that the adjustable-position fuel nozzle 504 supports a startup flame 514 using the fuel and the oxidant near the perforated flame holder 102. By moving the adjustable-position fuel nozzle 504 to the extended position, the startup flame 514 can be positioned close to the perforated flame holder 102, and is thus able to quickly heat the perforated flame holder 102 to a temperature that may exceed a threshold temperature at which the perforated flame holder 102 can support a combustion reaction (e.g., 302) of the fuel and the oxidant within the perforated flame holder 102.

According to an embodiment, the controller 108 can control the oxidant source 106 to output oxidant and the fuel source 517 to supply fuel to the adjustable-position fuel nozzle 504 at a relatively reduced flow rate. This can cause the adjustable-position fuel nozzle 504 to output the fuel at a relatively low velocity. Because of the reduced output velocity of the fuel, the startup flame 514 can be stably supported in a position between the adjustable-position fuel nozzle 504 and the perforated flame holder 102.

According to an embodiment, the oxidant source 106 provides an oxidant to the combustion environment by drafting air into the combustion environment via tubes, apertures in a furnace wall or floor, a blower (e.g., 238), or in any other suitable way.

When the perforated flame holder 102 has reached the threshold temperature, the controller 108 can cause the actuator 110 to retract the adjustable-position fuel nozzle 504 from the perforated flame holder 102, as discussed in more detail below with reference to FIG. 5B. Simultaneously, the ignition source 519 can stop ignition of the fuel exiting the adjustable-position fuel nozzle 504 such that fuel and oxidant are delivered to the heated perforated flame holder 102.

Figure 5B:
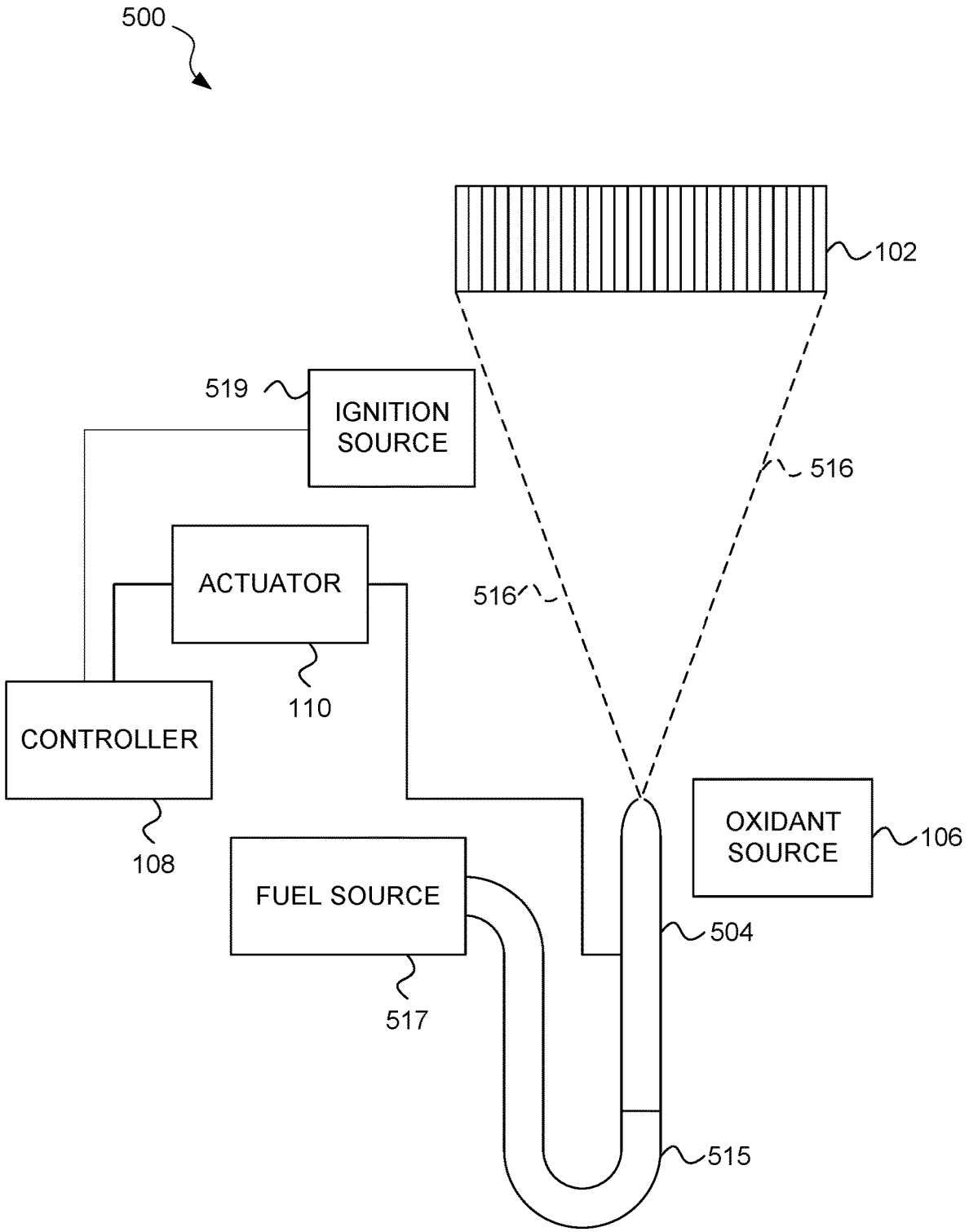
FIG. 5B is a diagram of the combustion system of FIG. 5A, with the adjustable-position fuel nozzle in a retracted position, according to an embodiment.

FIG. 5B is a diagram of the combustion system 500 after the controller 108 has caused the actuator 110 to retract the adjustable-position fuel nozzle 504 farther from the perforated flame holder 102, according to an embodiment. The fuel source 517 supplies fuel to the adjustable-position fuel nozzle 504 via the flexible hose 515. The adjustable-position fuel nozzle 504 outputs a fuel stream 516 from the retracted position onto the perforated flame holder 102. Because the perforated flame holder 102 has been preheated to the threshold temperature, the perforated flame holder 102 is capable of supporting a combustion reaction (e.g., 302) of the fuel and the oxidant within the perforated flame holder 102.

According to an embodiment, the controller 108 can also be coupled to the oxidant source 106 and the fuel source 517. The controller 108 can control the oxidant source 106 and the fuel source 517 to adjust the output of the oxidant and the fuel, respectively. For example, after the perforated flame holder 102 has been heated to the threshold temperature and the adjustable-position fuel nozzle 504 has been retracted, the controller 108 can cause the fuel source 517 to supply the fuel to the adjustable-position fuel nozzle 504 via the flexible hose 515 at an increased flow rate relative to the flow rate when in the extended position during a preheating operation of the combustion system 500. The adjustable-position fuel nozzle 504 outputs the fuel stream 516 from the retracted position onto the perforated flame holder 102 at an increased velocity. This enables the fuel to entrain the oxidant and impinge on the first face 212 of the perforated flame holder 102. Because the perforated flame holder 102 has been preheated to the threshold temperature, the perforated flame holder 102 is capable of supporting a combustion reaction (e.g., 302) of the fuel and the oxidant within the perforated flame holder 102.

The foregoing description with relation to FIG. 5A has described a situation in which the adjustable-position fuel nozzle 504 assists in preheating the perforated flame holder 102 by supporting the startup flame 514 near the perforated flame holder 102. Alternatively, the adjustable-position fuel nozzle 504 can adjust between different positions, all of which include outputting the fuel onto the perforated flame holder 102 so that the perforated flame holder 102 can support a combustion reaction of the fuel and oxidant mixture within the perforated flame holder 102. In other words, the position of the adjustable-position fuel nozzle 504 can be adjusted through extension or retraction to one of many possible positions in order to achieve selected characteristics of a combustion reaction (e.g., 302) supported by the perforated flame holder 102.

According to an embodiment, the position of the adjustable-position fuel nozzle 504 can be adjusted in order to adjust the area subtended by the fuel and oxidant mixture where the fuel and oxidant mixture comes into contact with the perforated flame holder 102. Under low load, it can be beneficial to concentrate a low fuel flow near the center of the perforated flame holder 102, so the adjustable-position fuel nozzle 504 can be extended. This maintains the temperature of at least a portion of the perforated flame holder 102 rather than spreading a small amount of combustion across the entire surface of the perforated flame holder 102. Under high load, when there is a lot of fuel output, the adjustable-position fuel nozzle 504 can be retracted so that the fuel covers most or all of the perforated flame holder 102 where the fuel intersects the perforated flame holder 102.

FIGS. 5A and 5B have been described as having a single adjustable-position fuel nozzle 504. However, according to an embodiment, the adjustable-position fuel nozzle 504 can include multiple fuel nozzles 504 each configured to output fuel. Thus, the adjustable-position fuel nozzle 504 can include multiple nozzles 504 whose positions can be adjusted together. Accordingly, an adjustable-position fuel nozzle 504 having multiple nozzles can receive fuel from the fuel source 517 and output the fuel to the respective nozzles. The individual fuel nozzles can output the fuel toward the perforated flame holder 102. The fuel can mix with the oxidant prior to being received by the perforated flame holder 102. The perforated flame holder 102 can support a combustion reaction (e.g., 302) of the fuel and the oxidant within the perforated flame holder 102.

While FIG. 5A and FIG. 5B disclose an adjustable-position fuel nozzle 504 that is positioned below the perforated flame holder 102 and configured to move along a vertical axis, other orientations are possible. For example, the adjustable-position fuel nozzle 504 can be positioned laterally from the perforated flame holder 102 and can output the fuel onto the perforated flame holder 102 in a horizontal direction. In this case, the adjustable-position fuel nozzle 504 can move along a horizontal axis, with the perforated flame holder 102 oriented such that the input face 212 can face the adjustable-position fuel nozzle 504 in the horizontal direction. Those of skill in the art will recognize, in light of the present disclosure, that other orientations of the adjustable-position fuel nozzle 504 and the perforated flame holder 102 are possible.

Figure 6:
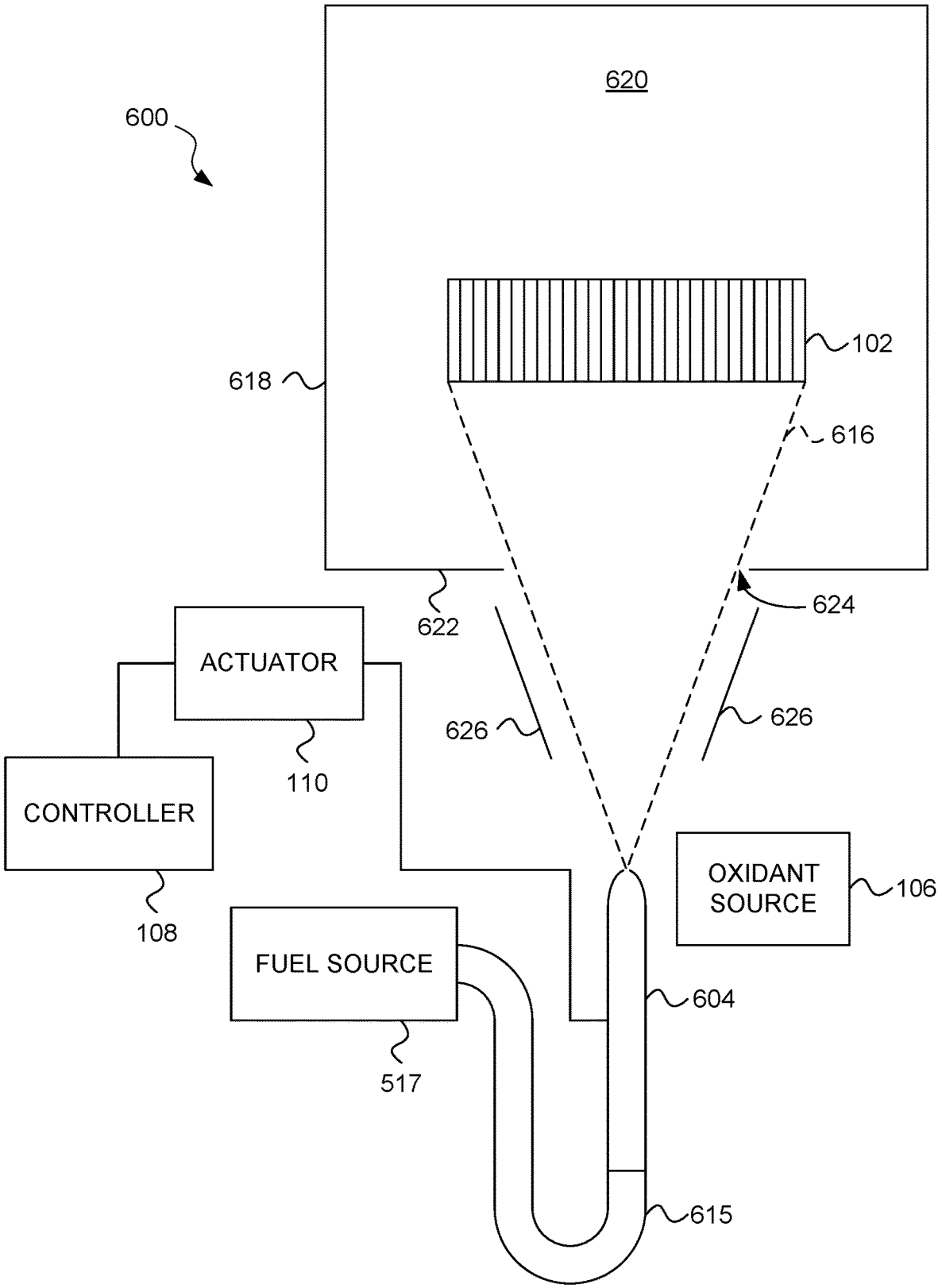
FIG. 6 is a diagram of a combustion system including a perforated flame holder and an adjustable-position fuel nozzle, according to an embodiment.

FIG. 6 is a diagram of a combustion system 600 including a wall 618 and a floor 622 that together define a combustion volume 620, according to an embodiment. A perforated flame holder 102 is positioned in the combustion volume 620 above an aperture 624 in the floor 622. An adjustable-position fuel nozzle 604 is in a retracted position below the aperture 624 in the floor 622. The adjustable-position fuel nozzle 604 is coupled to a fuel source 517 by a flexible hose 615. An oxidant source 106 is positioned to output oxidant into the combustion volume 620. An actuator 110 is coupled to the adjustable-position fuel nozzle 604. A controller 108 is coupled to the actuator 110. A shield 626 is positioned between the adjustable-position fuel nozzle 604 and the floor 622.

According to an embodiment, the adjustable-position fuel nozzle 604 can be retracted to a position below the floor 622. The adjustable-position fuel nozzle 604 outputs a fuel stream 616 through the aperture 624 in the floor 622, onto the perforated flame holder 102. The perforated flame holder 102 receives the fuel stream 616 including entrained oxidant and supports a combustion reaction (e.g., 302) of the fuel and the oxidant within the perforated flame holder 102.

In some situations, it is beneficial for the adjustable-position fuel nozzle 604 to be positioned relatively far from the perforated flame holder 102, in order to achieve particular fuel and oxidant mixture characteristics and/or to promote selected characteristics of the combustion reaction within the perforated flame holder 102. Because the adjustable-position fuel nozzle 604 can retract through the aperture 624 in the floor 622, the size of the combustion volume 620 can be decreased in comparison to a situation in which the adjustable-position fuel nozzle 604 is configured to remain in the combustion volume 620 even when retracted relatively far from the perforated flame holder 102. In such a situation, the perforated flame holder 102 can be positioned further above the floor 622, possibly requiring the combustion volume 620 to be correspondingly taller. Accordingly, the combustion system 600 including the adjustable-position fuel nozzle 604 that can be retracted far below the floor 622 of a furnace and may reduce the cost of the combustion system 600 while maintaining the benefits of operating the combustion system 600 while the adjustable-position fuel nozzle 604 is retracted relatively far from the perforated flame holder 102.

According to an embodiment, the shield 626 is positioned to prevent disruption of the flow of fuel from the adjustable-position fuel nozzle 604 by foreign objects or environmental factors. This can enhance safety in addition to stabilizing the combustion system 600.

According to an embodiment, the actuator 110 can adjust the position of the adjustable-position fuel nozzle 604 to extend through the aperture 624 in the floor 622 to a position relatively close to the perforated flame holder 102. In such an extended position, the adjustable-position fuel nozzle 604 can output a fuel stream 616 having selected characteristics upon being received by the perforated flame holder 102. Alternatively, in the extended position adjustable-position fuel nozzle 604 can support a startup flame 514 (not shown in FIG. 6) for heating the perforated flame holder 102 to a threshold temperature.

According to an embodiment, the position of the adjustable-position fuel nozzle 604 can be adjusted in order to adjust the area subtended by the fuel and the oxidant where they come into contact with the perforated flame holder 102. Under low load, it can be beneficial to concentrate a low fuel flow near the center of the perforated flame holder 102, so the adjustable-position fuel nozzle 604 can be extended. This maintains the temperature of the perforated flame holder 102 rather than spreading a small amount of combustion across its entire surface. Under high load, when there is a lot of fuel output, the adjustable-position fuel nozzle 604 can be retracted so that the fuel covers most or all of the perforated flame holder 102 where the fuel intersects the perforated flame holder 102.

While FIG. 6 discloses an embodiment where the adjustable-position fuel nozzle 604 that is positioned below the perforated flame holder 102 and configured to move along a vertical axis, other orientations are possible. For example, the adjustable-position fuel nozzle 604 can be positioned laterally from the perforated flame holder 102 and can output the fuel onto the perforated flame holder 102 in a horizontal direction. In this case, the adjustable-position fuel nozzle 604 can move along a horizontal axis, with the perforated flame holder 102 oriented such that the input face 212 can face the adjustable-position fuel nozzle 604 in the horizontal direction. Those of skill in the art will recognize, in light of the present disclosure, that other orientations of the adjustable-position fuel nozzle 604 and the perforated flame holder 102 are possible.

Figure 7A:
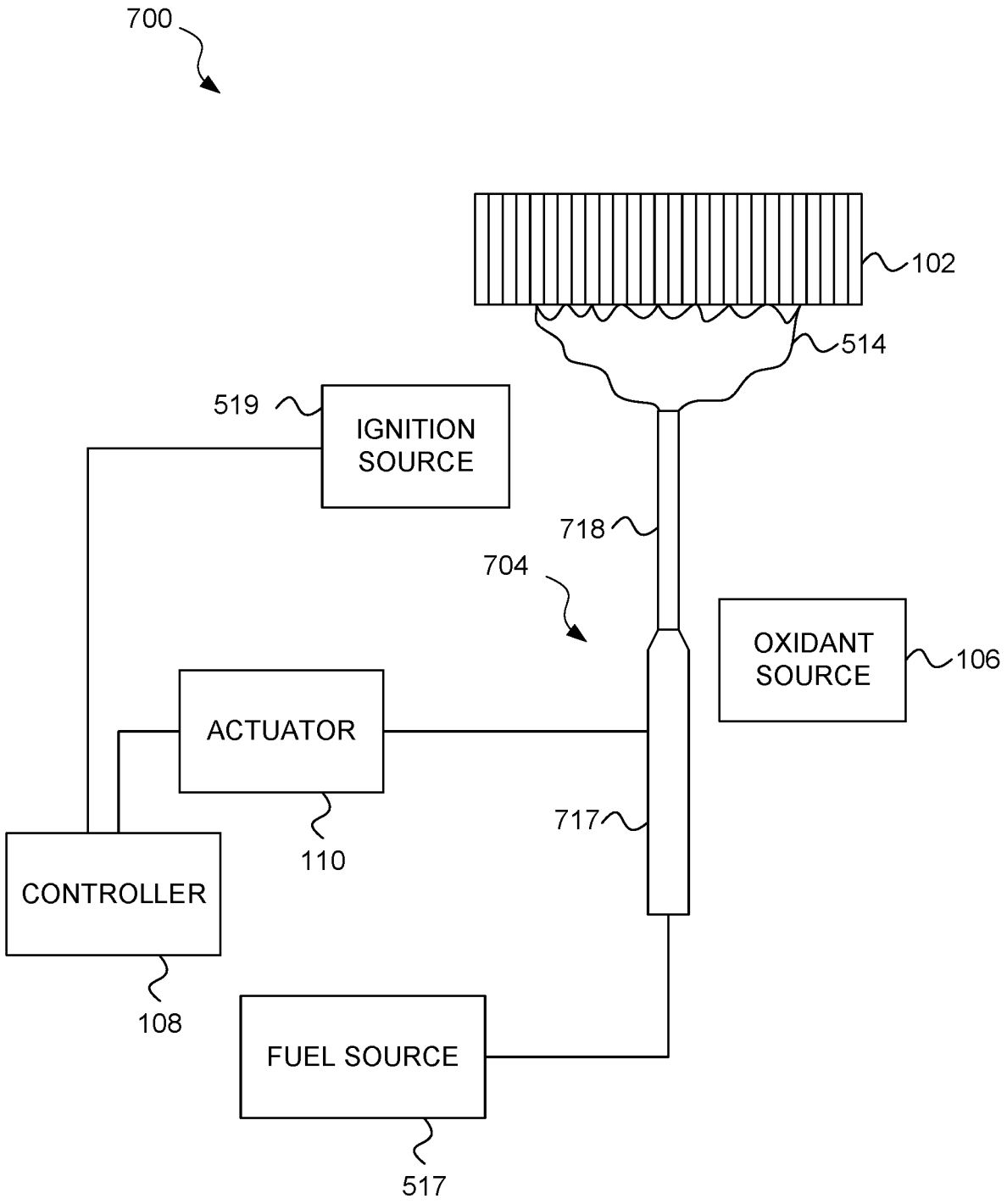
FIG. 7A is a diagram of a combustion system including a telescoping adjustable-position fuel nozzle in an extended position, according to an embodiment.

FIG. 7A is a diagram of a combustion system 700, according to an embodiment. The combustion system 700 includes a perforated flame holder 102, an oxidant source 106, a fuel source 517, and an adjustable-position fuel nozzle 704 configured to receive fuel from the fuel source 517. An actuator 110 is coupled to the adjustable-position fuel nozzle 704, and is configured to adjust a position of the adjustable-position fuel nozzle 704. The ignition source 519 is positioned near the adjustable-position fuel nozzle 704. A controller 108 is coupled to the actuator 110 and the ignition source 519.

According to an embodiment, the adjustable-position fuel nozzle 704 includes a first portion 717 and a second portion 718 coupled together in a telescoping configuration. The second portion 718 can be adjusted to extend from the first portion 717 to a position near the perforated flame holder 102. The second portion 718 can also be retracted within the first portion 717 to a position farther from the perforated flame holder 102. Thus, the overall length of the adjustable-position fuel nozzle 704 is adjustable.

In FIG. 7A, the adjustable-position fuel nozzle 704 is shown in an extended position, wherein, in combination with an ignition source 519 positioned near the adjustable-position fuel nozzle 704, the adjustable-position fuel nozzle 704 can act as a preheating mechanism for the perforated flame holder 102. In particular, the actuator 110, under control of the controller 108, has caused the second portion 718 to extend from the first portion 717 to a position near the perforated flame holder 102. The oxidant source 106 outputs oxidant. The fuel source 517 supplies fuel to the adjustable-position fuel nozzle 704. The adjustable-position fuel nozzle 704 outputs the fuel such that a startup flame 514 is supported near the perforated flame holder 102. By moving the second portion 718 of the adjustable-position fuel nozzle 704 to the extended position, the startup flame 514 can be positioned close to the perforated flame holder 102, and is thus able to quickly heat the perforated flame holder 102 to a temperature that may exceed a threshold temperature at which the perforated flame holder 102 can support a combustion reaction (e.g., 302) of the fuel and the oxidant within the perforated flame holder 102.

According to an embodiment, the controller 108 is coupled to the oxidant source 106 and the fuel source 517. The controller 108 controls the fuel source 517 to supply fuel to the adjustable-position fuel nozzle 704 at a relatively low flow rate, thereby reducing the velocity of the fuel output from the adjustable-position fuel nozzle 704. Because the velocity of the fuel is reduced, a stable startup flame 514 can be supported in a position between the adjustable-position nozzle 704 and the perforated flame holder 102. By moving the second portion 718 of the adjustable-position fuel nozzle 704 to the extended position, the startup flame 514 can be positioned close to the perforated flame holder 102, and is thus able to quickly heat the perforated flame holder 102 to a temperature that may exceed a threshold temperature at which the perforated flame holder 102 can support a combustion reaction (e.g., 302) of the fuel and the oxidant (e.g., a fuel and oxidant mixture) within the perforated flame holder 102.

According to an embodiment, the oxidant source 106 can provide oxidant to the combustion environment with a blower or by drafting air into the combustion environment via tubes, apertures in a furnace wall or floor, or in any other suitable way.

When the perforated flame holder 102 has reached the threshold temperature, the controller 108 can cause the actuator 110 to retract the second portion 718 of the adjustable-position fuel nozzle 704 from the perforated flame holder 102, as discussed in more detail below with reference to FIG. 7B, and can cause the ignition source 519 to stop ignition of a fuel stream exiting the adjustable-position fuel nozzle 704.

Figure 7B:
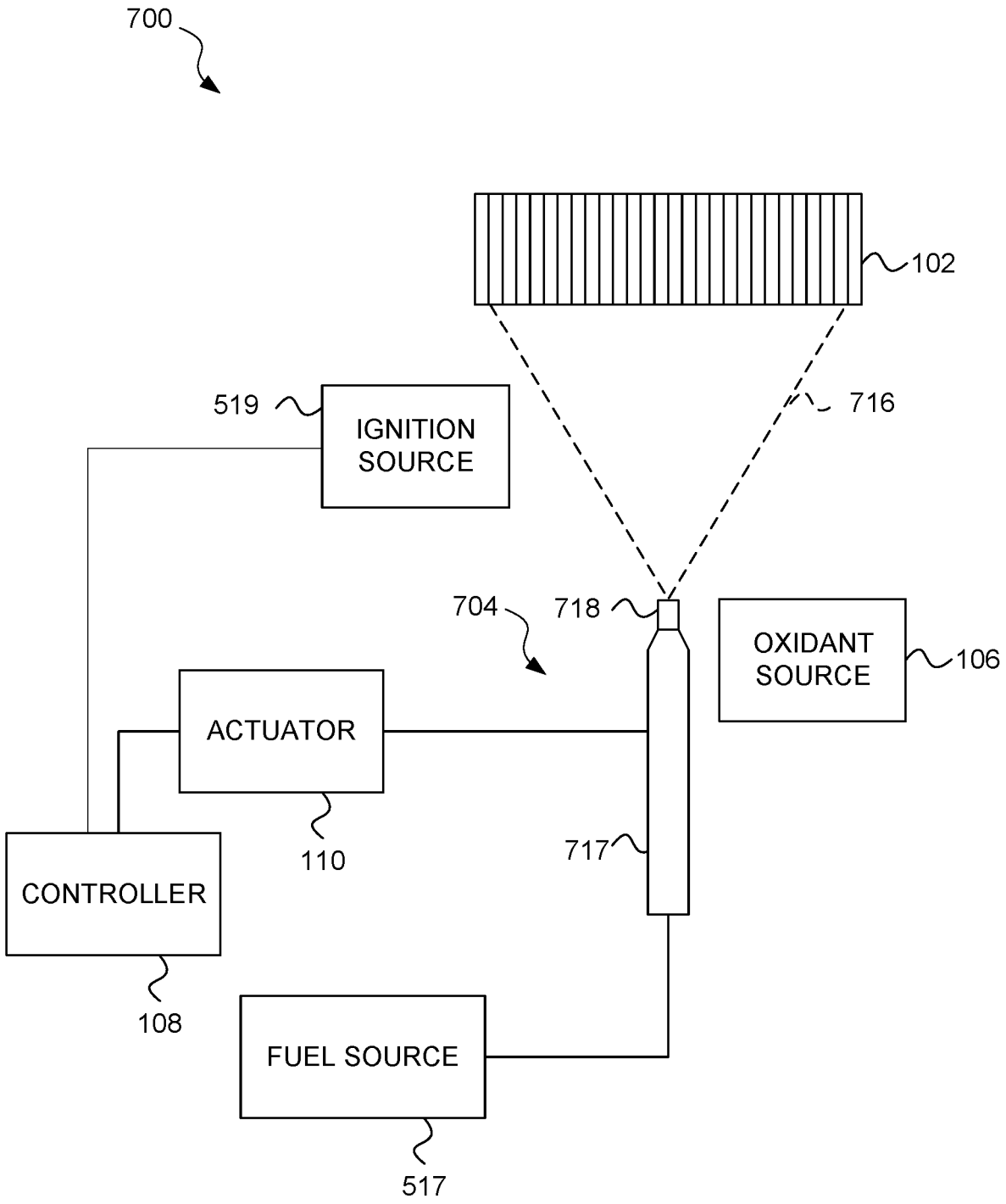
FIG. 7B is a diagram of the combustion system of FIG. 7A with the telescoping adjustable-position-length fuel nozzle in a retracted position, according to an embodiment.

FIG. 7B is a diagram of the combustion system 700 after the controller 108 has caused the actuator 110 to retract of the second portion 718 of the adjustable-position fuel nozzle 704 to a position farther from the perforated flame holder 102, according to an embodiment. The fuel source 517 to supplies the fuel to the adjustable-position fuel nozzle 704 via the flexible tube or hose 515. The adjustable-position fuel nozzle 704 outputs the fuel stream 716 from the retracted position onto the perforated flame holder 102. Because the perforated flame holder 102 has been preheated, the perforated flame holder 102 supports a combustion reaction 302 of the fuel and the oxidant within the perforated flame holder 102 within the perforated flame holder 102.

According to an embodiment, the controller 108 is coupled to the oxidant source 106 and the fuel source 517 and controls the output of the oxidant and the fuel. When in the retracted position, the controller 108 can cause the fuel source 517 to supply the fuel to the adjustable-position fuel nozzle 704 via the flexible tube or hose 515 at an increased flow rate. This causes the adjustable-position fuel nozzle 704 to output the fuel stream 716 from the retracted position onto the perforated flame holder 102 at an increased velocity and flow rate such that the fuel and entrained oxidant impinge on the perforated flame holder 102. Because the perforated flame holder 102 has been preheated, the perforated flame holder 102 supports a combustion reaction (e.g., 302) of the fuel and the oxidant, or mixture thereof, within the perforated flame holder 102.

The foregoing description with relation to FIG. 7A has described a situation in which the adjustable-position fuel nozzle 704 assists in preheating the perforated flame holder 102 by supporting a startup flame 514 near the perforated flame holder 102. Alternatively, the adjustable-position fuel nozzle 704 can adjust between different positions, all of which include outputting the fuel onto the perforated flame holder 102 so that the perforated flame holder 102 can support the combustion reaction (e.g., 302) of the fuel and the oxidant within the perforated flame holder 102. In other words, the position of the second portion 718 of the adjustable-position fuel nozzle 704 can be adjusted through extension or retraction to one of many possible positions in order to achieve selected characteristics of the combustion reaction (e.g., 302) supported by the perforated flame holder 102.

According to an embodiment, the position of the adjustable-position fuel nozzle 704 can be adjusted in order to adjust the area subtended by the fuel and the oxidant where the fuel and the oxidant come into contact with the perforated flame holder 102. Under low load, it can be beneficial to concentrate a low fuel flow near the center of the perforated flame holder 102, so the adjustable-position fuel nozzle 704 can be extended. This maintains the temperature of the perforated flame holder 102 rather than spreading a small amount of combustion across its entire surface. Under high load, when there is a lot of fuel output, the adjustable-position fuel nozzle 704 can be retracted so that the fuel covers most or all of the perforated flame holder 102 where the fuel intersects the perforated flame holder 102.

FIGS. 7A and 7B have been described as having a single adjustable-position fuel nozzle 704. However, according to an embodiment, the adjustable-position fuel nozzle 704 can include multiple nozzles 704, each configured to output fuel. Thus, the adjustable-position fuel nozzle 704 can include multiple nozzles 704 whose positions can be adjusted together or separately.

While FIG. 7A and FIG. 7B disclose an adjustable-position fuel nozzle 704 that is positioned below the perforated flame holder 102 and configured to move along a vertical axis, other orientations are possible. For example, the adjustable-position fuel nozzle 704 can be positioned laterally from the perforated flame holder 102 and can output fuel onto the perforated flame holder 102 in a horizontal direction. In this case, the adjustable-position fuel nozzle 704 can move along a horizontal axis, with the perforated flame holder 102 oriented such that the input face 212 can face the adjustable-position fuel nozzle 704 in the horizontal direction. Those of skill in the art will recognize, in light of the present disclosure, that other orientations of the adjustable-position fuel nozzle 704 and the perforated flame holder 102 are possible.

Figure 8A:
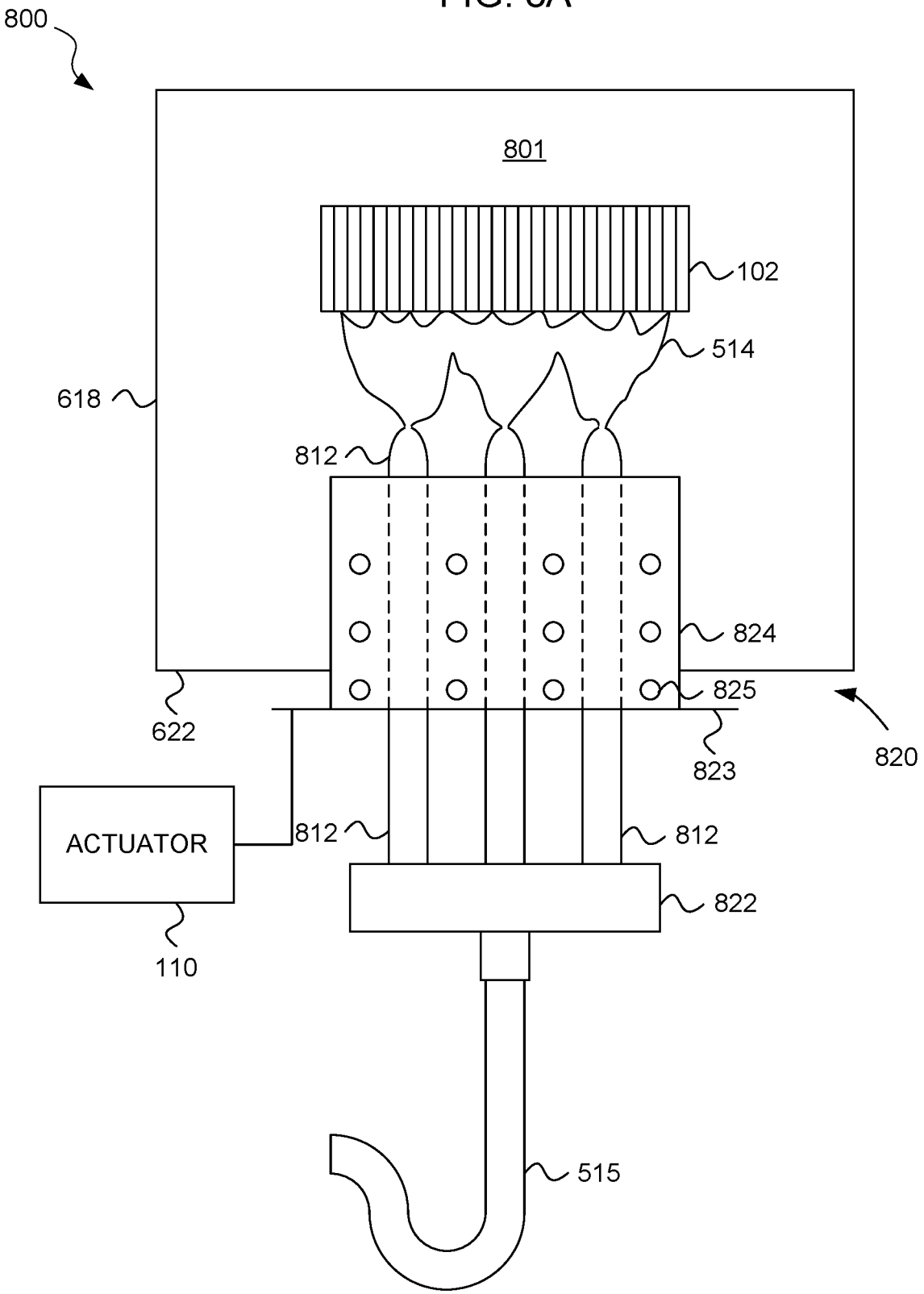
FIG. 8A is a diagram of a combustion system including an adjustable-position fuel and oxidant source assembly in an extended position, according to an embodiment.

FIG. 8A is a diagram of a combustion system 800 including a wall 618 and a floor 622 that together define a combustion volume 801, according to an embodiment. A perforated flame holder 102 is positioned in the combustion volume 801 above an aperture 624 (e.g., as shown in FIG. 6) in the floor 622. An adjustable-position fuel and oxidant source assembly 820 is disposed in the aperture 624 in the floor 622. An actuator 110 is coupled to the adjustable fuel and oxidant source assembly 820.

The adjustable-position fuel and oxidant source assembly 820 can include a fuel manifold 822 that receives fuel from a flexible tube or hose 515. Several fuel nozzles 812 can be each coupled to the fuel manifold 822 and receive the fuel from the fuel manifold 822. The adjustable-position fuel and oxidant source assembly 820 can include a rigid plate 823 having apertures through which the fuel nozzles 812 may extend. According to an embodiment, the fuel nozzles 812 may be fixed to the rigid plate 823. Additionally, the adjustable-position fuel and oxidant source assembly 820 can include an enclosure 824 laterally enclosing the fuel nozzles 812. The enclosure 824 may be fixed to the rigid plate 823. The portions of the fuel nozzles 812 located behind the enclosure 824 in the view of FIG. 8A are shown in dashed lines. The enclosure 824 does not include a top portion. The enclosure 824 can include apertures 825 through which combustion air including oxidant can pass into the combustion volume 801.

According to an embodiment, the actuator 110 is coupled to the adjustable-position fuel and oxidant source assembly 820. Additionally, or alternatively, the actuator 110 can be coupled to the rigid plate 823. The actuator 110 is configured to move the entire adjustable-position fuel and oxidant source assembly 820 toward or away from the perforated flame holder 102 by moving the rigid plate 823.

In FIG. 8A, the adjustable-position fuel and oxidant source assembly 820 is in an extended position wherein the adjustable-position fuel and oxidant source assembly 820 can act as a preheating mechanism for the perforated flame holder 102. In particular, the actuator 110, under control of a controller 108 (not shown), has moved the adjustable-position fuel and oxidant source assembly 820 to a position near the perforated flame holder 102. With the adjustable-position fuel and oxidant source assembly 820 in the extended position, the fuel nozzles 812 are relatively near the perforated flame holder 102. The fuel manifold 822 supplies fuel to the fuel nozzles 812. Oxidant is provided to the combustion volume 801 via the apertures 825. As illustrated in FIG. 8A, the extended position of the oxidant source assembly 820 provides access for oxidant ingress via at least a subset of the apertures 825. The fuel nozzles 812 support a startup flame 514 by using the fuel and oxidant near the perforated flame holder 102.

According to an embodiment, a controller e.g., 108 (not pictured in FIG. 8A) controls the adjustable fuel and oxidant source assembly 820 to output the fuel at a relatively reduced velocity and flow rate. Because of the reduced output velocity, the startup flame 514 can be stably supported in a position between the adjustable-position fuel nozzle 812 and the perforated flame holder 102. By moving the fuel and oxidant source assembly 820 to the extended position, the startup flame 514 can be positioned close to the perforated flame holder 102, and is thus able to quickly heat the perforated flame holder 102 to a temperature that may exceed a threshold temperature at which the perforated flame holder 102 can support a combustion reaction (e.g., 302 of FIG. 3) of the fuel and the oxidant within the perforated flame holder 102.

When the perforated flame holder 102 has reached the threshold temperature, the controller 108 can cause the actuator 110 to move the fuel and oxidant source assembly 820 away from the perforated flame holder 102, as discussed in more detail below with reference to FIG. 8B.

Figure 8B:
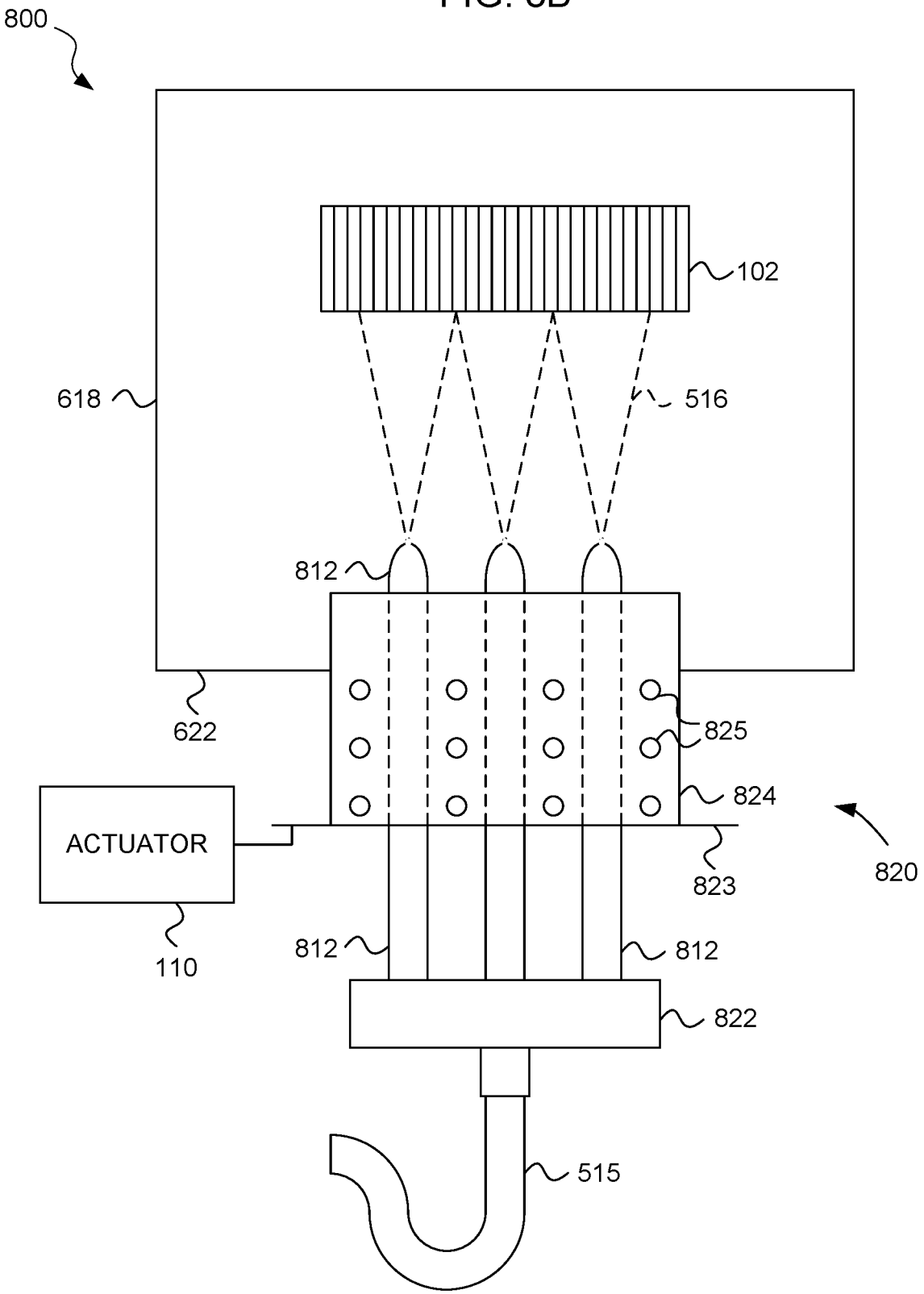
FIG. 8B is a diagram of the combustion system of FIG. 8A with the adjustable-position fuel and oxidant source assembly in a retracted position, according to an embodiment.

FIG. 8B is a diagram of the combustion system 800 after the controller 108 has caused the actuator 110 to retract the fuel and oxidant source assembly 820 to a position farther from the perforated flame holder 102, according to an embodiment. The controller 108 causes the fuel nozzles 812 to output the fuel from the retracted position onto the perforated flame holder 102 at the increased velocity and flow rate. Because the perforated flame holder 102 has been preheated, the perforated flame holder 102 supports a combustion reaction of the fuel and the oxidant within the perforated flame holder 102. In the retracted position illustrated in FIG. 8B, the oxidant source assembly 820 accommodates greater oxidant ingress via a larger number of the apertures 825.

The foregoing description with relation to FIG. 8A has described a situation in which the fuel and oxidant source assembly 820 assists in preheating the perforated flame holder 102 by supporting the startup flame 514 near the perforated flame holder 102. Alternatively, the fuel and oxidant source assembly 820 can adjust between different positions, all of which include outputting fuel onto the perforated flame holder 102 so that the perforated flame holder 102 can support the combustion reaction of the fuel and oxidant within the perforated flame holder 102. In other words, the adjustable-position fuel and oxidant source assembly 820 can be extended or retracted to one of many possible positions in order to achieve selected characteristics of the combustion reaction supported by the perforated flame holder 102.

Figure 8C:
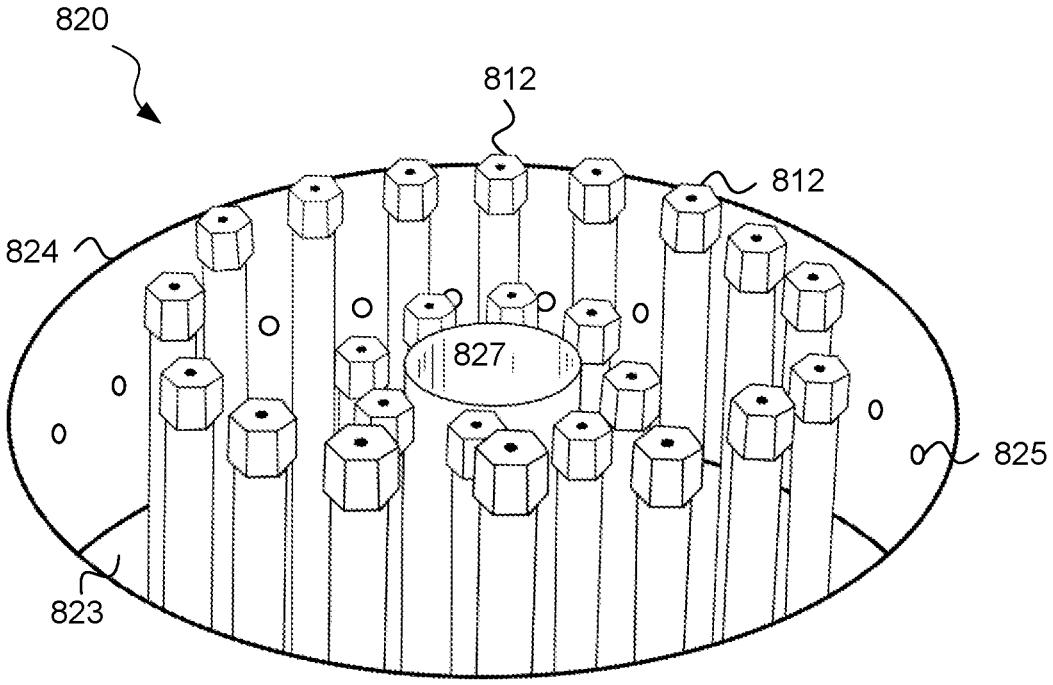
FIG. 8C is an elevated perspective view of a portion of the adjustable-position fuel and oxidant source assembly of FIG. 8A, according to an embodiment.

FIG. 8C is an elevated perspective view of a portion of the adjustable-position fuel and oxidant source assembly 820, according to an embodiment. This embodiment of the adjustable-position fuel and oxidant source assembly 820 includes a cylindrical enclosure 824 laterally surrounding a plurality of fuel nozzles 812. While only three fuel nozzles 812 are shown in FIG. 8A and FIG. 8B, the adjustable-position fuel and oxidant source assembly 820 can include a larger number of the fuel nozzles 812, such as shown in FIG. 8C. According to an embodiment, some of the fuel nozzles 812 can output a fuel while others output an oxidant.

The cylindrical enclosure 824 may include a plurality of apertures 825 through which combustion air including oxidant can pass into the combustion volume 801. A large diameter pilot flame source 827 is positioned at the center of the array of fuel nozzles 812. The positions of the fuel nozzles 812 and the pilot flame source 827 may be selected such that the pilot flame ignites fuel exiting from the inner ring of fuel nozzles 812 and does not ignite fuel exiting from the outer ring of fuel nozzles 812. Accordingly, by actuating respective fuel valves (e.g., 236 in FIG. 2) for particular fuel nozzles 812, an electronic controller or an operator can cause fuel exiting a set of the fuel nozzles 812 to be ignited to preheat the perforated flame holder 102 (not shown in FIG. 8C), or not ignited to be combusted in the perforated flame holder 102.

Figure 9:
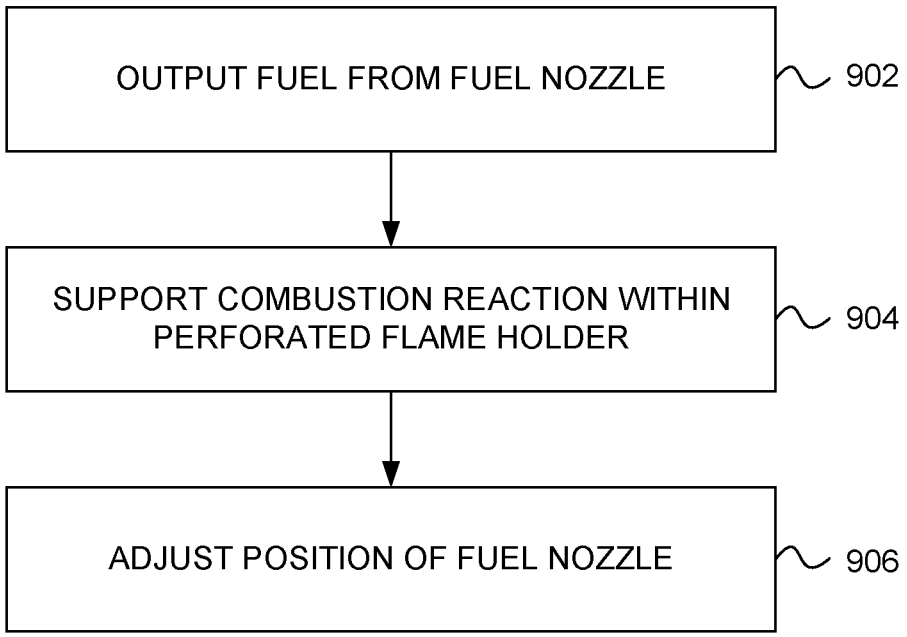
FIG. 9 is a flow diagram of a process for operating a combustion system including a perforated flame holder and an adjustable-position fuel nozzle, according to one embodiment.

FIG. 9 is a flow diagram of a process 900 for operating a combustion system including a perforated flame holder (e.g., 102) and an adjustable-position fuel nozzle (e.g., 504, 604, 704, or 812), according to an embodiment. At 902, fuel is output from the adjustable-position fuel nozzle. At 904, a combustion reaction of the fuel and an oxidant is supported within the perforated flame holder. At 906, the position of the adjustable-position fuel nozzle is adjusted relative to the perforated flame holder in order to achieve selected characteristics of the combustion reaction within the perforated flame holder.

Figure 10:
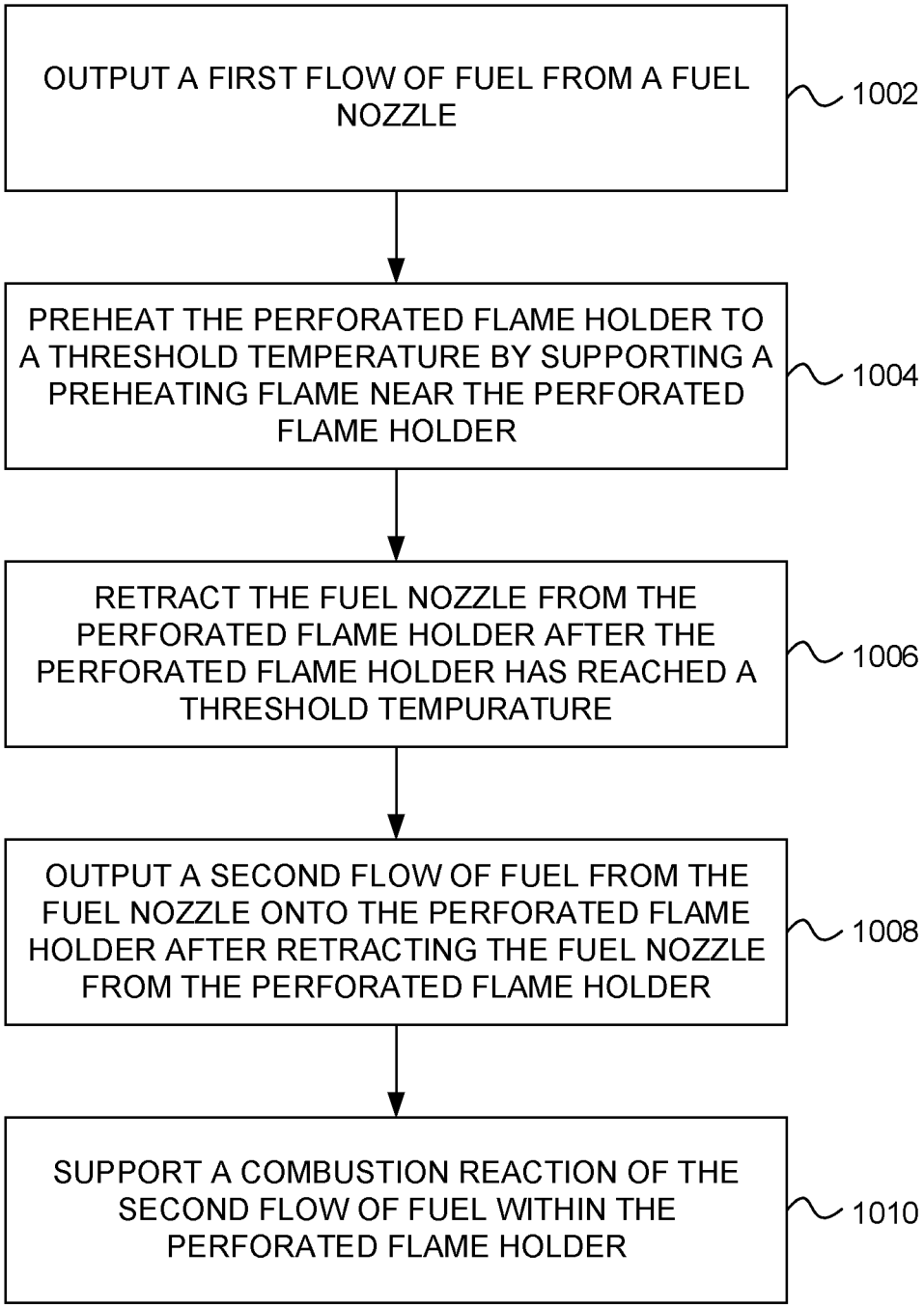
FIG. 10 is a flow diagram of a process for operating a combustion system including a perforated flame holder and an adjustable-position fuel nozzle, according to another embodiment.

FIG. 10 is a flow diagram of a process 1000 for operating a combustion system including a perforated flame holder (e.g., 102) and an adjustable-position fuel nozzle (e.g., 504, 604, 704, or 812), according to another embodiment. At 1002, a first flow of fuel is output from the adjustable-position fuel nozzle(s). At 1004, the perforated flame holder is preheated to a threshold temperature by supporting a preheating flame near the perforated flame holder. At 1006, the adjustable-position fuel nozzle is retracted from the perforated flame holder after the perforated flame holder has reached the threshold temperature. At 1008, a second flow of fuel is output from the adjustable-position fuel nozzle onto the perforated flame holder after retracting the adjustable-position fuel nozzle from the perforated flame holder. At 1010, a combustion reaction of the second flow of fuel is supported within the perforated flame holder.

Figure 11A:
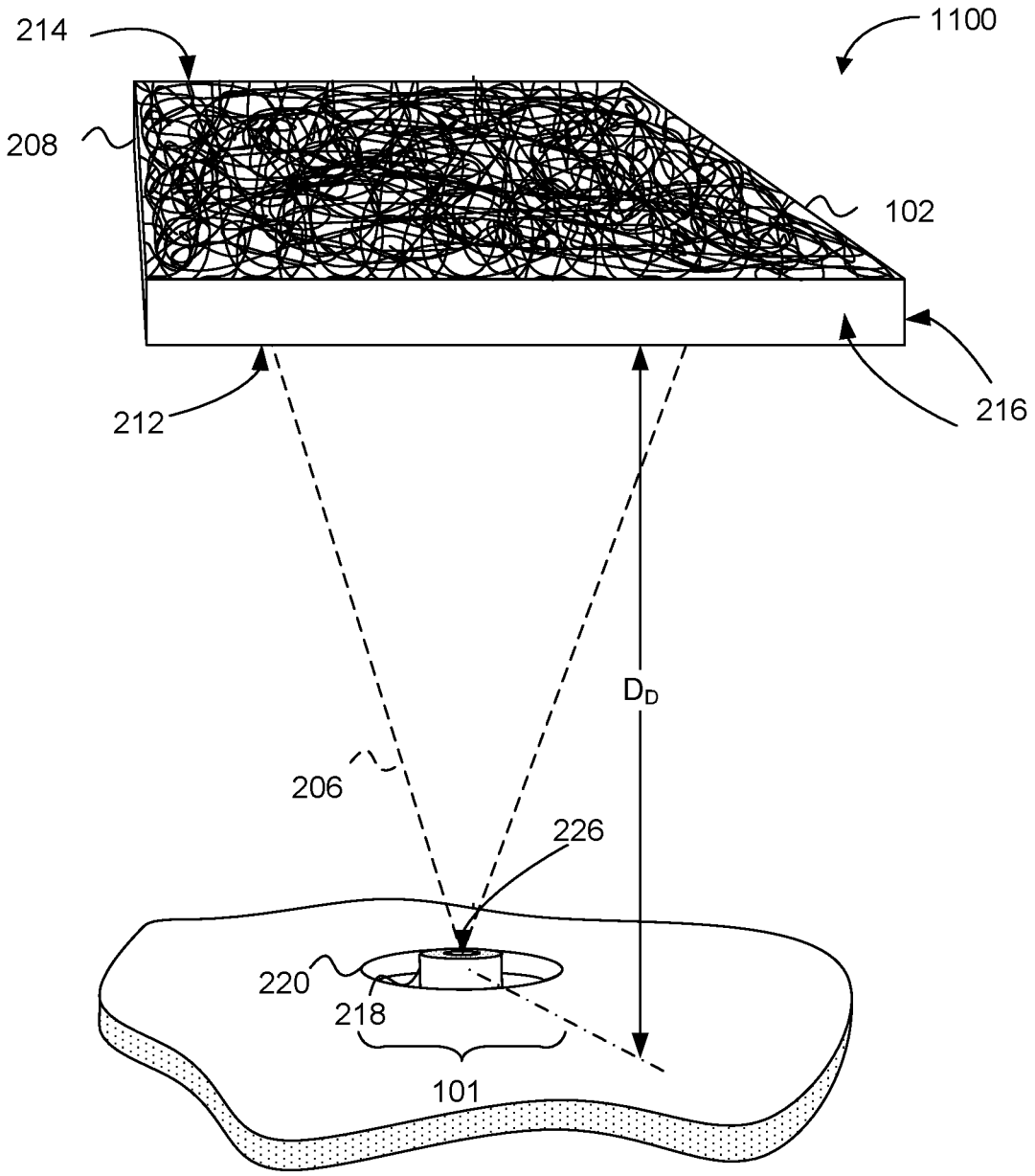
FIG. 11A is a simplified perspective view of a combustion system including a reticulated ceramic perforated flame holder, according to an embodiment.

FIG. 11A is a simplified perspective view of a combustion system 1100, including another alternative perforated flame holder 102, according to an embodiment. The perforated flame holder 102 is a reticulated ceramic perforated flame holder, according to an embodiment.

Figure 11B:
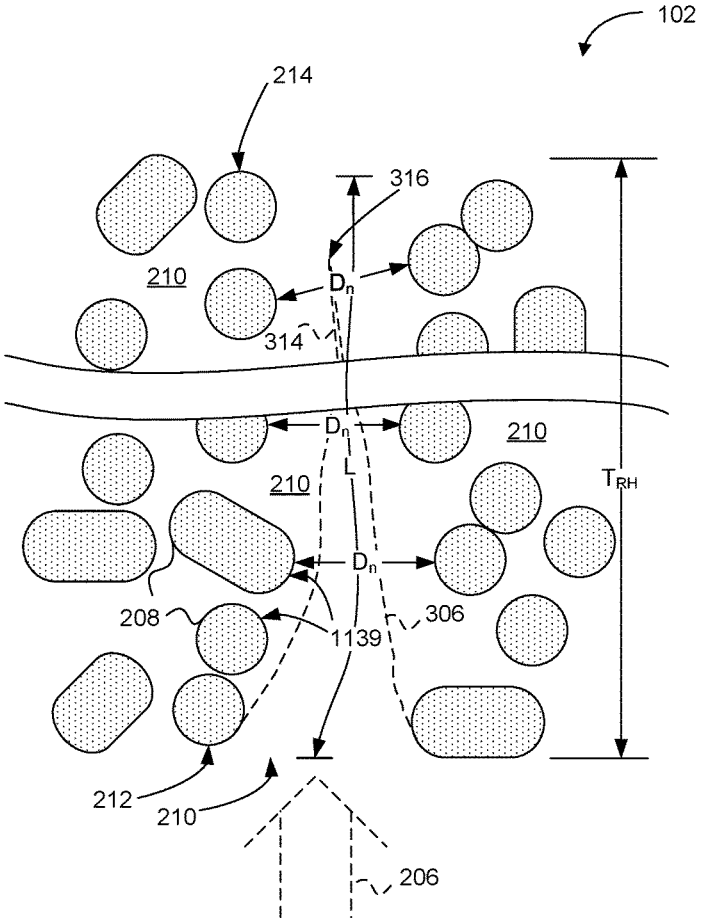
FIG. 11B is a simplified side sectional diagram of a portion of the reticulated ceramic perforated flame holder of FIG. 11A, according to an embodiment.

FIG. 11B is a simplified side sectional diagram of a portion of the reticulated ceramic perforated flame holder 102 of FIG. 11A, according to an embodiment. The perforated flame holder 102 of FIGS. 11A, 11B can be implemented in the various combustion systems described herein, according to an embodiment. The perforated flame holder 102 is configured to support a combustion reaction (e.g., 302 of FIG. 3) of the fuel and oxidant mixture 206 at least partially within the perforated flame holder 102. According to an embodiment, the perforated flame holder 102 can be configured to support a combustion reaction of the fuel and oxidant mixture 206 upstream, downstream, within, and adjacent to the reticulated ceramic perforated flame holder 102.

According to an embodiment, the perforated flame holder body 208 can include reticulated fibers 1139. The reticulated fibers 1139 can define branching perforations 210 that weave around and through the reticulated fibers 1139. According to an embodiment, the perforations 210 are formed as passages through the reticulated ceramic fibers 1139.

According to an embodiment, the reticulated fibers 1139 can include alumina silicate. According to an embodiment, the reticulated fibers 1139 can be formed from extruded mullite or cordierite. According to an embodiment, the reticulated fibers 1139 can include Zirconia. According to an embodiment, the reticulated fibers 1139 can include silicon carbide.

The term "reticulated fibers" refers to a netlike structure. According to an embodiment, the reticulated fibers 1139 are formed from an extruded ceramic material. In reticulated fiber embodiments, such as in FIGS. 11A, 11B, the interaction between the fuel and oxidant mixture 206, the combustion reaction, and heat transfer to and from the perforated flame holder body 208 can function similarly to the embodiment shown and described above with respect to FIGS. 2-4. One difference in activity is a mixing between perforations 210, because the reticulated fibers 1139 form a discontinuous perforated flame holder body 208 that allows flow back and forth between neighboring perforations 210.

According to an embodiment, the reticulated fiber network is sufficiently open for downstream reticulated fibers 1139 to emit radiation for receipt by upstream reticulated fibers 1139 for the purpose of heating the upstream reticulated fibers 1139 sufficiently to maintain combustion of a fuel and oxidant mixture 206. Compared to a continuous perforated flame holder body 208, heat conduction paths 312 between the reticulated fibers 1139 are reduced due to separation of the reticulated fibers 1139. This may cause relatively more heat to be transferred from the heat-receiving region 306 (heat receiving area) to the heat-output region 310 (heat output area) of the reticulated fibers 1139 via thermal radiation (see element 304 in FIG. 3).

According to an embodiment, individual perforations 210 may extend from an input face 212 to an output face 214 of the perforated flame holder 102. Perforations 210 may have varying lengths L. According to an embodiment, because the perforations 210 branch into and out of each other, individual perforations 210 are not clearly defined by a length L.

According to an embodiment, the perforated flame holder 102 is configured to support or hold a combustion reaction or a flame at least partially between the input face 212 and the output face 214. According to an embodiment, the input face 212 corresponds to a surface of the perforated flame holder 102 proximal to the fuel nozzle 218 or to a surface that first receives fuel. According to an embodiment, the input face 212 corresponds to an extent of the reticulated fibers 1139 proximal to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 1139 distal to the fuel nozzle 218 or opposite to the input face 212.

According to an embodiment, the formation of boundary layers 314, transfer of heat between the perforated reaction holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 212 to the output face 214 through the perforated reaction holder 102. According to an embodiment, the void fraction (expressed as (total perforated reaction holder 102 volume—reticulated fiber 1139 volume)/total volume)) is about 70%.

According to an embodiment, the reticulated ceramic perforated flame holder 102 is a tile about 1"×4"×4". According to an embodiment, the reticulated ceramic perforated flame holder 102 includes about 10 pores per linear inch of surface area. Other materials and dimensions can also be used for a reticulated ceramic perforated flame holder 102 in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single perforated flame holder 102. Alternatively, each reticulated ceramic tile can be considered a distinct perforated flame holder 102.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method, comprising:

outputting fuel from an adjustable-position fuel nozzle onto a perforated flame holder, the fuel being directed for mixture with an oxidant en route to the perforated flame holder;

supporting a combustion reaction of the fuel and the oxidant within the perforated flame holder; and adjusting a position of the adjustable-position fuel nozzle relative to the perforated flame holder.

2. The method of claim 1, further comprising:

supplying the fuel to the adjustable-position fuel nozzle; and supplying the oxidant for the mixture with the fuel, wherein at least the oxidant is supplied through an aperture in a floor of a combustion volume that holds the perforated flame holder.

3. The method of claim 2, further comprising preheating the perforated flame holder to a threshold temperature by:

moving the adjustable-position fuel nozzle relatively near the perforated flame holder; and supporting a startup flame near the perforated flame holder.

4. The method of claim 2, wherein the supplying of the fuel to the adjustable-position fuel nozzle includes supplying the fuel from a flexible hose.

5. The method of claim 4, wherein adjusting a position of the adjustable-position fuel nozzle includes adjusting a position of the flexible hose.

6. The method of claim 1, wherein the fuel includes a fuel oil.

7. The method of claim 1, wherein the adjusting a position of the adjustable-position fuel nozzle includes:

extending the adjustable-position fuel nozzle toward the perforated flame holder to support a preheating flame near the perforated flame holder; and retracting the adjustable-position fuel nozzle from the perforated flame holder after the perforated flame holder has been preheated.

8. A method, comprising:

outputting fuel from an adjustable-position fuel nozzle onto a perforated flame holder, the fuel being directed for mixture with an oxidant en route to the perforated flame holder;

supporting a combustion reaction of the fuel and the oxidant within the perforated flame holder; and adjusting a position of the adjustable-position fuel nozzle relative to the perforated flame holder;

wherein the adjusting a position of the adjustable-position fuel nozzle includes:

extending the adjustable-position fuel nozzle toward the perforated flame holder to support a preheating flame near the perforated flame holder; and retracting the adjustable-position fuel nozzle from the perforated flame holder after the perforated flame holder has been preheated; and further comprising outputting a second flow of the fuel from one or more secondary fuel nozzles after retracting the adjustable-position fuel nozzle.

9. A method, comprising:

outputting a first flow of fuel from an adjustable-position fuel nozzle;

preheating a perforated flame holder to a threshold temperature by supporting a preheating flame of the first flow of fuel with the adjustable-position fuel nozzle positioned near the perforated flame holder;

retracting the adjustable-position fuel nozzle from the perforated flame holder after the perforated flame holder has been preheated to the threshold temperature;

outputting a second flow of fuel from the adjustable-position fuel nozzle onto the perforated flame holder after retracting the adjustable-position fuel nozzle from the perforated flame holder; and supporting a combustion reaction of the second flow of fuel within the perforated flame holder.

10. The method of claim 9, wherein retracting the adjustable-position fuel nozzle includes retracting a first portion of the adjustable-position fuel nozzle within a second portion of the adjustable-position fuel nozzle.

11. The method of claim 9, wherein retracting the adjustable-position fuel nozzle includes retracting a fuel and oxidant source assembly.

* * * * *